US008652740B2

(12) United States Patent
Fowlkes

(10) Patent No.: US 8,652,740 B2
(45) **Date of Patent: *Feb. 18, 2014**

(54) BALANCING DISCHARGE AREA DEVELOPED AND TRANSFERRED TONER

(75) Inventor: William Y. Fowlkes, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 37 days.

This patent is subject to a terminal disclaimer.

(21) Appl. No.: 13/018,172

(22) Filed: Jan. 31, 2011

(65) Prior Publication Data

US 2012/0196224 A1 Aug. 2, 2012

(51) Int. Cl.
*G03G 13/16* (2006.01)

(52) U.S. Cl.
USPC ..... 430/125.3; 430/42.1; 430/45.31

(58) Field of Classification Search
USPC ..... 430/42.1, 45.31, 123.5, 123.52, 124.1, 430/125.3, 125.5
See application file for complete search history.

(56) References Cited

U.S. PATENT DOCUMENTS

| | | | | |
|---|---|---|---|---|
| 3,724,422 | A | 4/1973 | Latone et al. | |
| 3,927,641 | A | 12/1975 | Handa | |
| 4,041,903 | A | 8/1977 | Katakura et al. | |
| 4,984,026 | A * | 1/1991 | Nishise et al. | 399/302 |
| 5,234,783 | A | 8/1993 | Ng | |
| 5,905,012 | A | 5/1999 | De Meutter et al. | |
| 5,926,679 | A | 7/1999 | May et al. | |
| 6,608,987 | B2 | 8/2003 | Bartscher et al. | |
| 6,880,463 | B2 | 4/2005 | DeMeulemeester et al. | |
| 7,016,621 | B1 | 3/2006 | Ng | |
| 7,120,379 | B2 | 10/2006 | Eck et al. | |
| 7,389,073 | B2 | 6/2008 | Kumar et al. | |
| 8,092,970 | B2 * | 1/2012 | Tyagi et al. | 430/124.1 |
| 8,158,313 | B2 * | 4/2012 | Tsukamoto et al. | 430/45.1 |
| 2002/0168200 | A1 | 11/2002 | Stelter et al. | |
| 2009/0162113 | A1 | 6/2009 | Solcz et al. | |
| 2012/0196223 | A1 * | 8/2012 | Fowlkes | 430/124.1 |

FOREIGN PATENT DOCUMENTS

| | | |
|---|---|---|
| JP | 62-049377 | 3/1987 |
| JP | 2000-231279 | 8/2000 |
| JP | 2005-189719 | 7/2005 |
| JP | 2007-328061 | 12/2007 |

OTHER PUBLICATIONS

IS & T's 1997 International Conference on Digital Printing Technologies, UV-cured Toners for Printing and Coating on Paper-like Substrates, pp. 168-172, Detlef Schuzle-Hagenest, Micheal Huber, Saskia Udding-Louwrier and Paul H.G. Binda.

* cited by examiner

*Primary Examiner* — Stewart Fraser
(74) *Attorney, Agent, or Firm* — Roland R. Schendler, II

(57) ABSTRACT

Printing methods are provided. In one aspect, at least one first toner image is formed and transferred onto a receiver to form a composite toner image on a receiver having a first polarity. A second net development difference of potential of the first polarity is created between a second development station, a bias member and the first toner at each location of the receiver, to cause a second toner of the first polarity to deposit at individual locations on the receiver in amounts that according to the second net development difference of potential at the individual locations such that total amount of first toner and any second toner deposited at each location on the receiver is within a range that is less than a range of first toner amounts on the receiver.

21 Claims, 21 Drawing Sheets

BALANCING DISCHARGE AREA DEVELOPED AND TRANSFERRED TONER

CROSS REFERENCE TO RELATED APPLICATIONS

This application relates to commonly assigned, copending U.S. application Ser. No. 13/018,188, filed Jan. 31, 2011, entitled: "ENHANCEMENT OF DISCHARGED AREA DEVELOPED TONER LAYER"; U.S. application Ser. No. 13/018,158, filed Jan. 31, 2011, entitled: "ENHANCEMENT OF CHARGE AREA DEVELOPED TONER LAYER"; U.S. application Ser. No. 13/018,148, filed Jan. 31, 2011, entitled: "BALANCING CHARGE AREA DEVELOPED AND TRANSFERRED TONER"; U.S. application Ser. No. 13/018,183, filed Jan. 31, 2011, entitled: "PRINTER WITH DISCHARGE AREA DEVELOPED TONER BALANCING"; and U.S. application Ser. No. 13/018,136, filed Jan. 31, 2011, entitled: "PRINTER WITH CHARGE AREA DEVELOPED TONER BALANCING"; each of which is hereby incorporated by reference.

FIELD OF THE INVENTION

This invention pertains to the field of printing.

BACKGROUND OF THE INVENTION

In color electrophotography, a full color image is built up by sequentially transferring individual color separation toner images in registration onto a receiver and fusing the toner and receiver. A clear toner can also be provided over the color separation toner images. Such a clear toner protects the color separation toner images from damage due to environmental conditions or from incidental contact.

A clear toner can also improve the gloss of the full color image. Gloss is an optical property that represents the extent to which a surface such as an exterior surface of a fused toner image reflects light at an angle that mirrors an angle of incidence of that light. Several factors can influence the gloss of a toner image fused to a receiver. The primary factors include the general uniformity of the refractive index of the toner used to form the exterior surface of the fused toner image, the flatness of the exterior surface of the fused toner image, and in certain circumstances, the gloss of the receiver.

It will be appreciated that a full color toner image can have an exterior surface that includes toner from any of the color separation toner toners as may be necessary to provide the desired combination of colors and the index of refraction of the toner that is present at an upper layer of the full color toner image can vary with the index of refraction of the color separation toner that is last applied at each layer of the toner stack. Light that strikes the exterior surface at an angle of incidence can be reflected at different angles because of such differences in the index of refraction. Accordingly, a more uniform index of refraction can be provided at an exterior surface of a fused color toner image by providing a common clear toner over the color separation toners.

It is known in the art to apply such a clear layer to color separation images using a clear coating apparatus that applies, for example, a generally uniform coating of a clear material and that fixes the clear material to the toner image by exposing this material to ultraviolet light. For example, Schulze-Hagenest, et al., disclose UV-curable toners for use to form durable prints on paper and cardboard substrates in UV-cured Toners for Printing and Coating on Paper-like Substrates, 13th International Conference on Digital Printing Technologies (Imaging Science and Technology, 1997) pp. 168-172. Also described is apparatus for the UV curing (crosslinking) of such UV-curable toners at elevated temperatures, i.e., above the glass transition temperature (T.sub.g) of the toner. A radiant fusing step, using IR radiation to heat the toner, is followed by a separate UV curing step in which the toner is in a molten or quasi-molten state. The IR pre-fusing provides a smooth film, while the subsequent UV curing reaction is very rapid. UV-crosslinkable toner formulations are disclosed in U.S. Pat. No. 6,608,987 issued to Bartscher, et al. and in U.S. Pat. No. 5,905,012 issued to De Meutter, et al.

In another example, U.S. Pat. No. 5,926,679, issued to May, et al., discloses that a clear (non-marking) toner layer can be laid down on a photoconductive member (e.g., imaging cylinder) prior to forming a marking particle toner image thereon, and that a clear toner layer can be laid down as a last layer on top of a marking particle toner image prior to transfer of the image to an intermediate transfer member (e.g., blanket cylinder). It is also disclosed that a clear toner layer can be laid down on a blanket cylinder prior to transferring a marking particle toner image from a photoconductive member. In one aspect of this patent, a non-imagewise clear toner layer is bias-developed on to an intermediate transfer member using a uniform charger and a non-marking toner development station. A first monocolor toner image corresponding to one of the marking toners is transferred to the ITM (on top of the clear toner) from a primary imaging member which may be a roller or a web but is preferably a roller. Subsequently, a second monocolor toner image corresponding to another of the marking toners is transferred to the ITM (on top of and in registration with the first toner image) and so forth until a completed multicolor image stack has been transferred on top of the clear toner on the ITM. The ITM is then positioned at a sintering exposure station; where a sintering radiation is turned on to sinter the toner image for a predetermined length of time.

The clear toner that is applied to the color separation toner images in accordance with such methods can provide the protective function and can also create a generally uniform index of refraction at the exterior surface of a fused toner image formed on the receiver after fusing to provide improved gloss performance.

However, differences in the amount of color separation toner applied to form different colors form what are known as toner stacks and can cause different the toner stacks to have a different toner stack heights. The difference between toner stack heights can cause relief differentials to exist in the exterior surface of the fused toner image. The relief differentials disrupt the flatness of the exterior surface of such a color toner image. These relief differentials cause light to reflect along different paths and this, in turn, reduces the apparent gloss of the fused toner image.

This effect can be illustrated by reference to FIGS. 1 and 2. FIG. 1 depicts an exemplary section of a receiver member 2 having a plurality of color toner stacks 4A-4N. As can be seen from FIG. 1, color toner stacks 4A-4N provide a range of color toner stack heights before fusing, with the toner stack heights varying based upon the total amount of color toner in each toner stack. As is also seen in FIG. 1, a uniform layer of clear toner uniformly increases the toner stack heights leaving the magnitude of any toner stack height differences unchanged but at a higher level relative to receiver 2.

FIG. 2 shows the section of FIG. 1 after fusing. As is shown in FIG. 2, the pressure and heat applied during a typical fusing process tends to cause the color toner stacks to be pressed together to form a toner mass 6 having an exterior surface 8.

As is also illustrated in FIG. 2, exterior surface 8 has a relief pattern with peaks that generally correspond to locations on the receiver member 2 on which higher toner stacks 4A-4N are formed and valleys that generally correspond to locations on the receiver member 2 having comparatively lower toner stacks.

For example, a peak area 10 on surface 8 that corresponds to high density color image elements is shown in FIG. 1 as being formed at areas of the toner image formed by toner having comparatively higher toner stack heights e.g. toner stack 4D and a valley area 12 that corresponds to lower density color image elements shown in FIG. 1 as having a lower toner stack height e.g. toner stack 4E in FIG. 1. Such relief differentials reflect incident light from a common source (not shown) in different directions thereby creating a reduction in gloss. For example, as is shown in FIG. 2, parallel rays of light 14A, 14B and 14C strike different portions of fused toner 8, and are at least in part reflected by exterior surface 8 as reflected rays of light 16A, 16B and 16C that travel in different directions. Accordingly, only a portion of the parallel rays 14A, 14B and 14C can be seen by an observer or detector at a position 18 that mirrors the angle of incidence of the parallel rays 14A, 14B, and 14C on surface 10. This reduces the overall apparent gloss level of the toner image formed on receiver member 2.

It will be appreciated from this that the application of a clear toner in amounts that vary inversely with an amount of color toner in a toner stack can reduce these relief differentials and improve gloss. Accordingly, there have been various attempts to use imagewise application of a clear toner to help form a fused toner image having reduced relief differentials. Often this is done by determining a pattern of clear toner that is calculated to provide reduced relief differentials when applied to the toner stacks formed by the color separation toner images that will be applied to a receiver. This pattern is then converted into the form of image data that can be printed by a printing module to provide a toner image that has reduced relief differentials after fusing.

For example, U.S. Pat. No. 5,234,783, issued on Aug. 10, 1993, in the name of Yee S. Ng, et al., describes a process where a gloss of a printed image is improved by applying gloss improving clear toner image to the color toner stacks forming the image. The gloss producing clear toner image provides clear toner in amounts that vary inversely according to the amounts of toner provided by the color separation images providing ultimately an even height toner image. Similarly, U.S. Pat. No. 7,016,621, issued on Mar. 21, 2006 in the name of Yee S. Ng, describes the formation of a toner image wherein back-transfer artifacts are reduced or eliminated without the need or expense of providing uniform coverage of clear toner to the print wherein a five color tandem printer is used to print fewer than five colors. In this patent, the first four printing stations are used to print a color toner image having a range of stack heights and a fifth station is used to deposit a clear toner image having less clear toner in areas of the color separation toner images having more color separation toner and more clear toner in areas of the color toner image having lower amounts of color separation toner.

Such relief reducing applications of toner are known as inverse mask toner images. The use of inverse mask toner images provides high gloss outcomes by helping to cause exterior surface 8 of a fused color toner image to have a consistent index of refraction and reduced relief differentials. Such inverse mask methods can require the use of a printing module to selectively apply clear toner to specific color toner stacks, requires calculation to determine which toner stack are to receive the amounts of clear toner applied according to the inverse mask, requires that the clear toner is carefully written and transferred in register to the underlying color toner stacks. These steps can require precise calculation, electrical and mechanical control.

It will also be understood that in an electrophotographic printer, a development process is used to deposit toner onto a surface. In this process, a development station supplying charged toner is provided in close proximity to an engine pixel location on a primary imaging member. The difference of potential is established across the toner and the picture element location. Toner deposits onto to the engine pixel location according to the difference of potential therebetween. However, the difference of potential decreases as charged toner transfers to the picture element location. Accordingly, while the net difference of potential at the start of a development step can be high, this net difference of potential decreases as development progresses, slowing the development process and effectively limiting the overall amount of toner developed onto picture element locations of the primary imaging member.

Development efficiency can be characterized as a ratio of a difference of potential between a development station and the engine pixel location during development and a difference of potential between development station and the toned pixel. Development efficiency limitations can be particularly noticeable when the difference of potential between a development station and the charge at the engine pixel location being developed is relatively low or where development efficiency varies during development of an image. Further, in toner images that use multiple layers of color toner, there can be significant differences in the development efficiencies for each layer of toner applied. These development efficiency differences can exacerbate relief differences that already exist between large toner piles formed in high difference of potential areas and comparatively low difference of potential areas that will have low toner stack heights.

Various schemes are known in the art to provide improved development efficiency. These typically seek to improve the development efficiency of a single toner by positioning multiple development stations along a primary imaging member in order to present the same toner to the same portions of a primary imaging member multiple times effectively increasing the amount of time during which development can occur and allowing full development at lower potentials. The overall development efficiencies of each color separation will be closer to a desired development efficiency. Examples of such methods include U.S. Pat. Nos. 3,724,422 issued to Latone et al.; 3,927,641 issued to Handa, 4,041,903 issued to Katakura et al. Such approaches can improve toner development efficiency but require additional structure to enable the formation of an inverse mask.

What are needed therefore are new methods and apparatuses for applying an inverse masking toner to toner stacks formed from one or more color separation toners forming a toner image in amounts that vary inversely with the amount of color separation toner in the toner stacks to form an exterior surface of the fused toner image that has a more uniform index of refraction and reduced relief differentials. Another need in the art is for methods and apparatuses to be provided that allow application of inverse masking toner to compensate for development efficiency limitations. Still another need in the art is for methods and apparatuses to be provided that allow the formation of such an inverse mask toner without requiring calculation of second toner amounts based on analysis of color separation data, without requiring an image printing module to selectively position the inverse masking toner relative to the toner stacks or to adjustably control the amount of inverse mask toner applied to particular toner stacks.

What are needed therefore are new methods and apparatuses for applying an inverse masking toner to toner stacks formed from one or more color separation toners forming a toner image in amounts that vary inversely with the amount of color separation toner in the toner stacks to form an exterior surface of the fused toner image that has a more uniform index of refraction and reduced relief differentials.

Still another need in the art is for methods to be provided that allow the application of such a protective and gloss improving toner in specific amounts on specific toner stacks in toned portions of a receiver. This requires precise registration with the toner stacks formed in the color toner image. Even minor mis-registration can yield highly unpredictable results that can increase relief differentials and decrease rather than increase gloss.

Yet another need in the art is for methods and apparatuses to be provided that allow application of inverse masking toner to compensate toner stack height variations without requiring calculation of second toner amounts based on analysis of color separation data without requiring an image printing module to selectively position the inverse masking toner relative to the toner stacks or to adjustably control the amount of inverse mask toner applied to particular toner stacks.

SUMMARY OF THE INVENTION

Printing methods are provided. In one aspect at least one first toner image is formed by charging a primary imaging member to have an image modulated difference of potential of a first polarity between a higher difference of potential and a lower difference of potential relative to a ground at locations on the primary imaging member where toner is to be developed and to have an image modulated difference of potential above the higher difference of potential at locations on the primary imaging member where no toner is to be developed; establishing a first development difference of potential of the first polarity between the higher difference of potential and the lower difference of potential at a first development station to form a first net development difference of potential between the first development station and individual engine pixel locations on the primary imaging member with the first net development difference of potential being the first development difference of potential less any image modulated difference of potential at the engine pixel location; and positioning a first toner charged at the first polarity at the first development station such that the first toner is electrostatically urged to deposit in the individual engine pixel locations according to the first net development difference of potential for the individual engine pixel locations and the formed at least one toner image is transferred to form a composite toner image on a receiver.

A second net development difference of potential of the first polarity is created between a second development station, a bias member and the first toner at each location on the receiver used for printing, with the second net development difference of potential being a second development difference of potential between the second development station and the bias member less any difference of potential relative to ground of any first toner at the locations and a second toner of the first polarity is provided at the second development station such that the second toner is electrostatically urged to deposit at individual locations on the receiver in an amount according the second net development difference of potential at the individual locations. The second development difference of potential is set at a level such that second toner is deposited on the receiver to cause a total amount of first toner and any second toner deposited at each location on the receiver to be maintained within a range that is less than a range of first toner amounts on the receiver.

DETAILED DESCRIPTION OF THE DRAWINGS

Figure 8A:
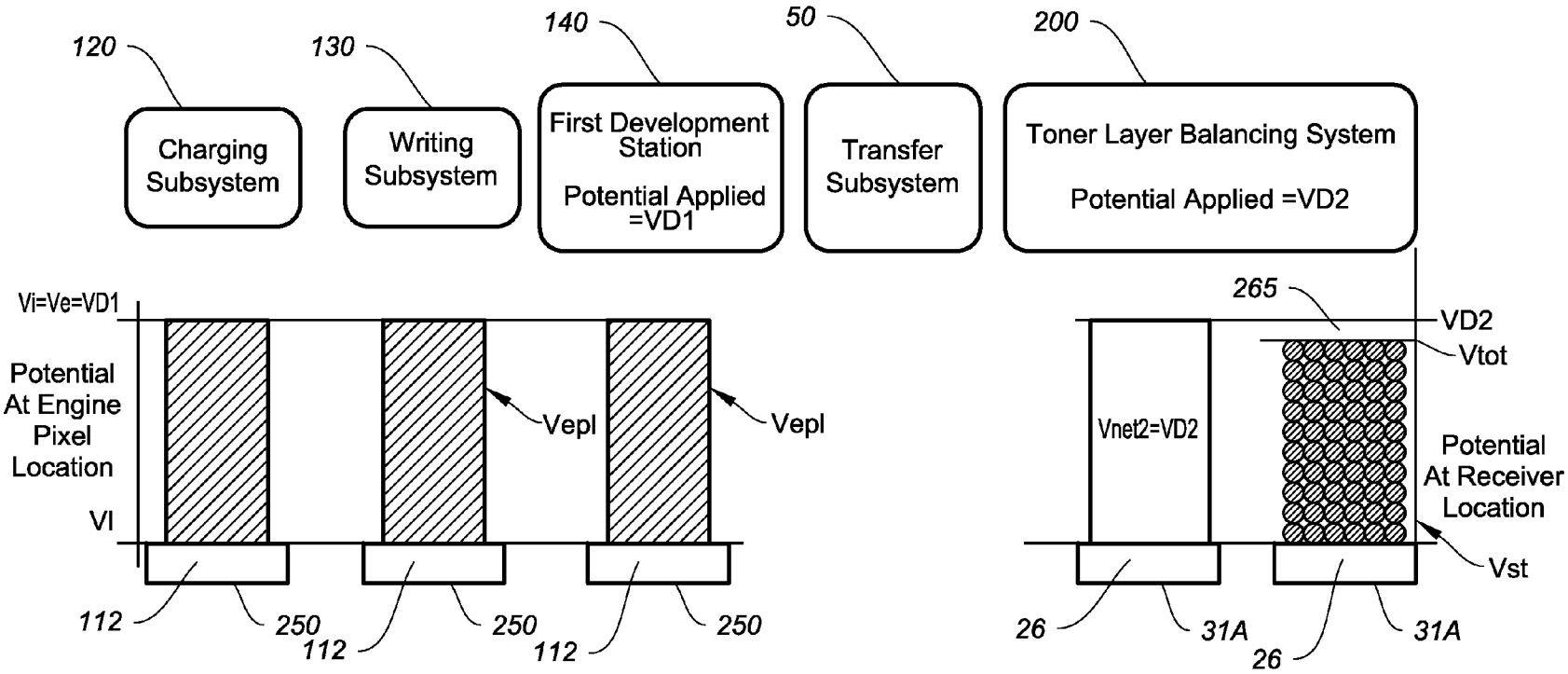
Figure 8B:
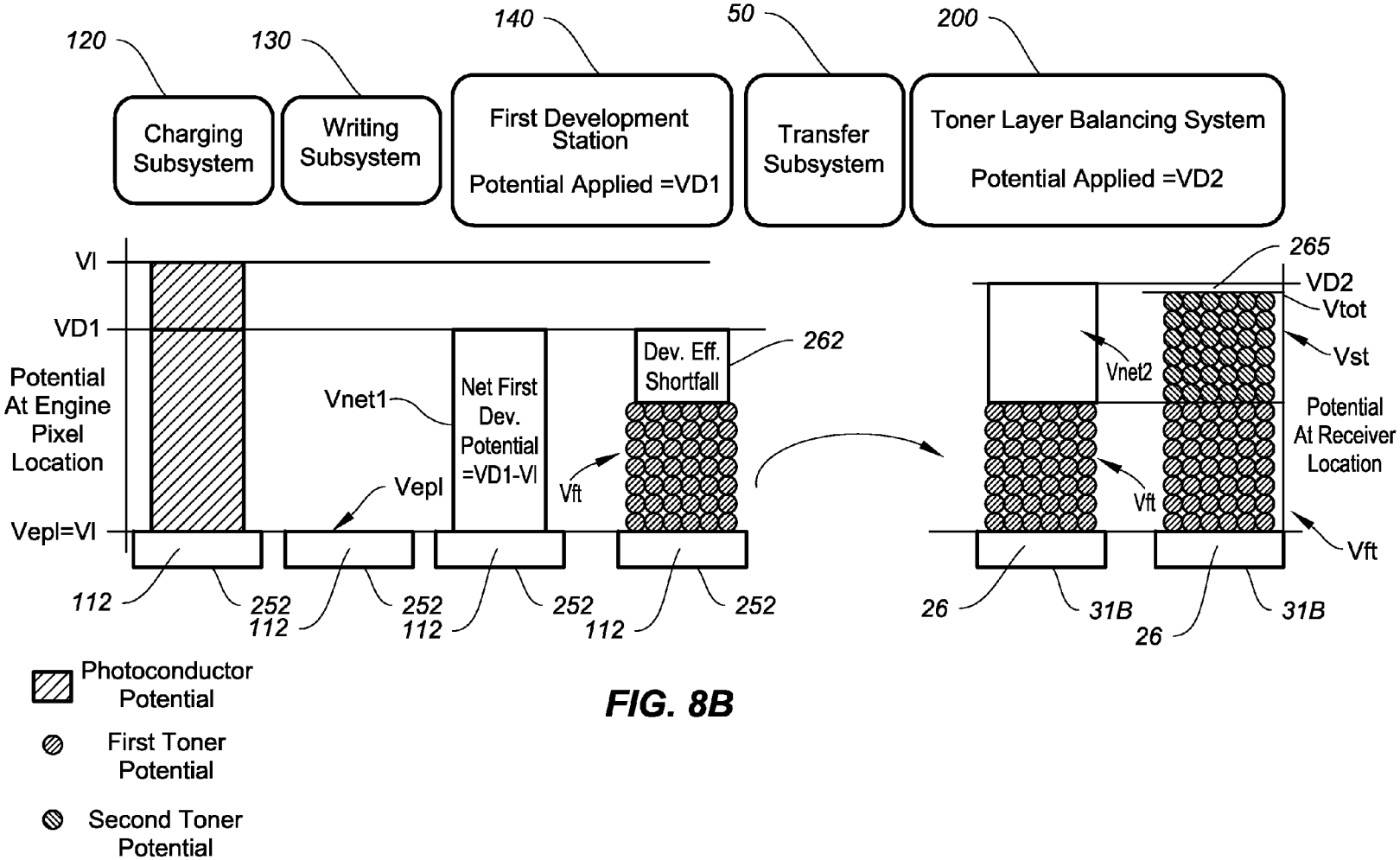
Figure 8C:
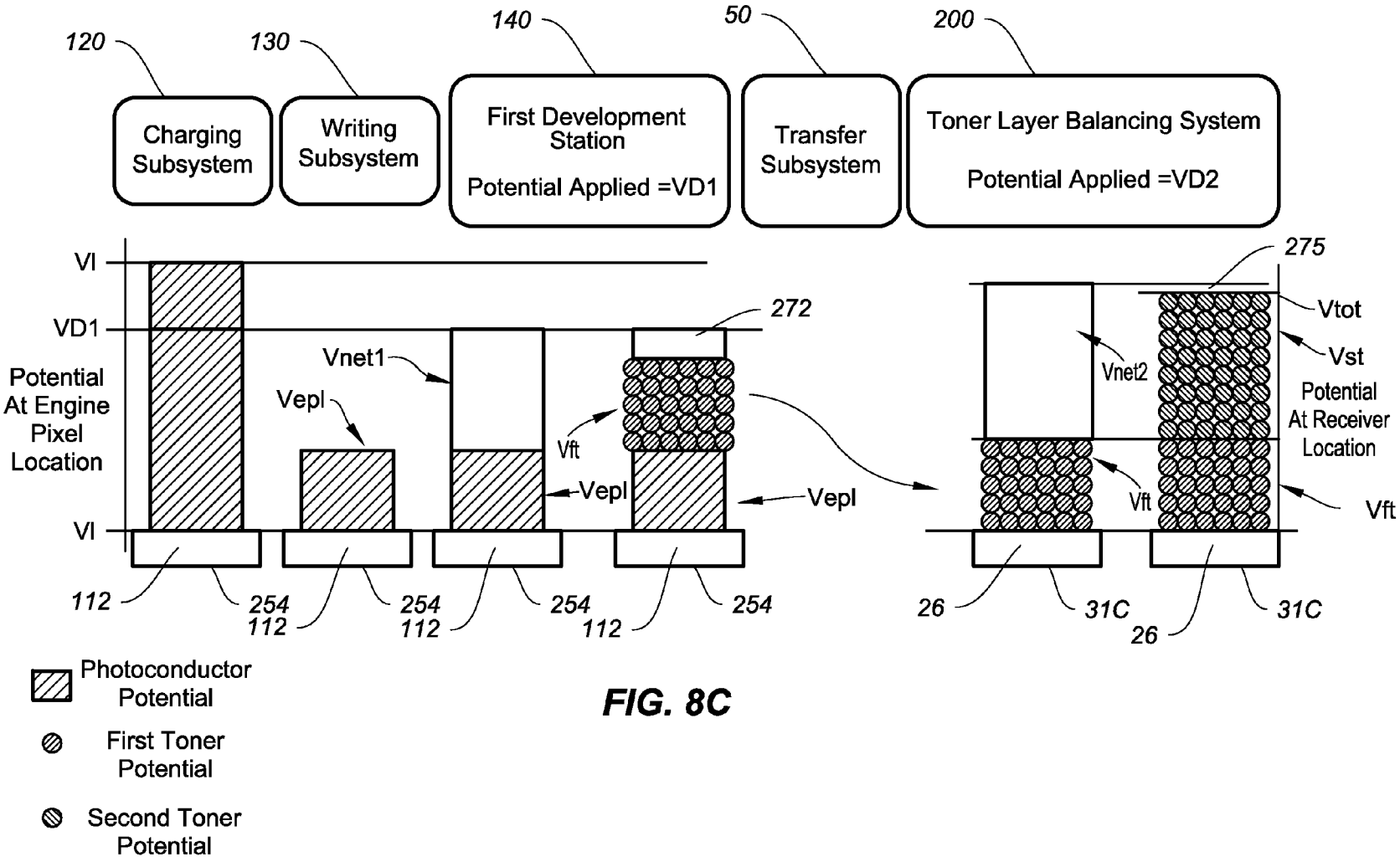

FIGS. 8A-8C provide illustrations depicting the operation of the method of FIG. 6 to reduce stack height variations according to a first extent.

Figure 7:
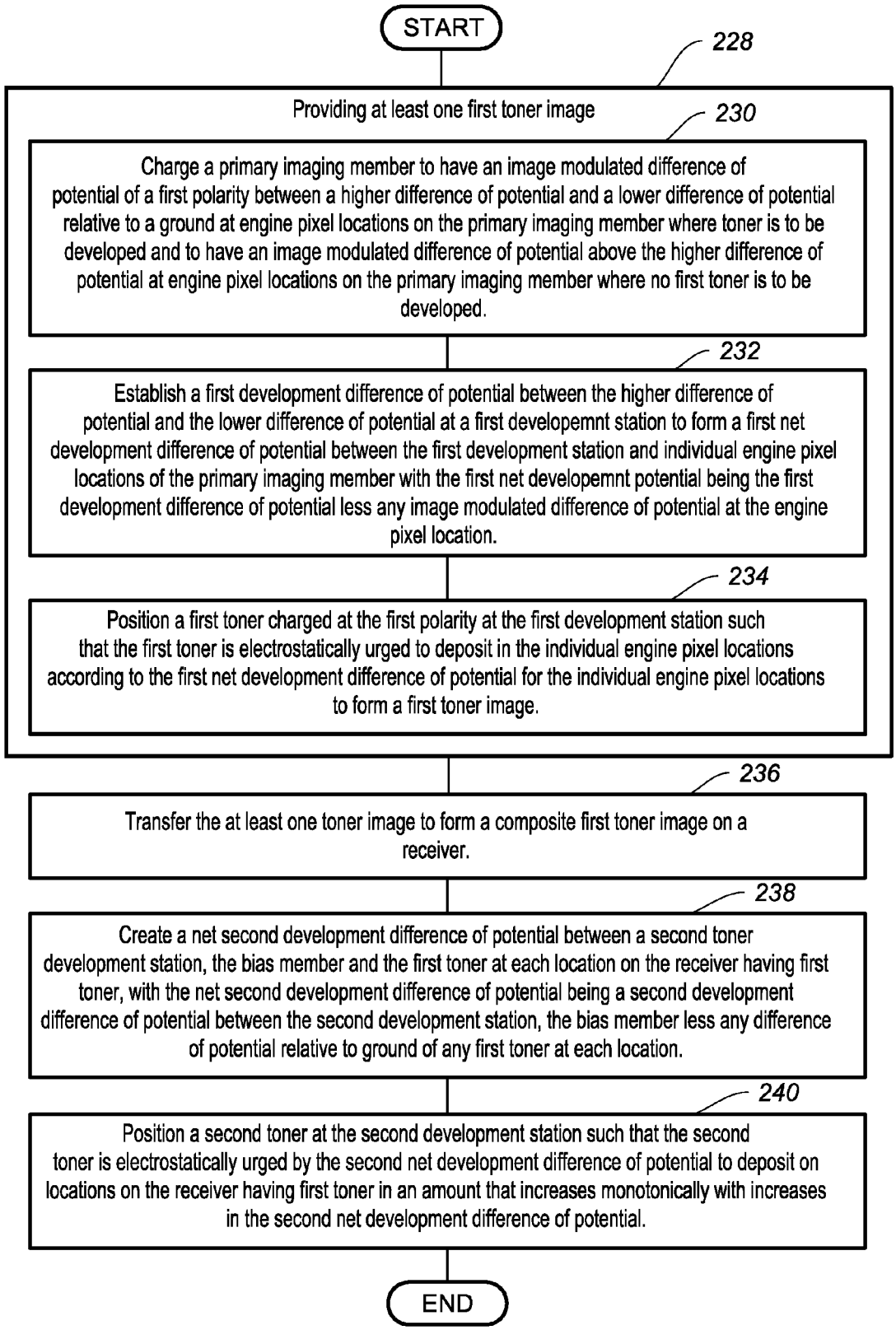
FIG. 7 shows a first embodiment of a printing method.
Figure 9A:
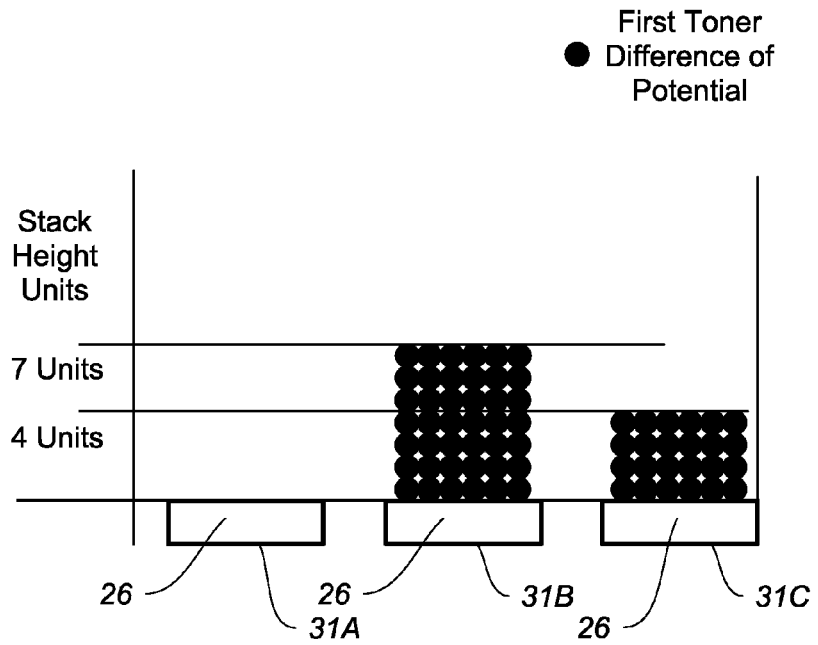
Figure 9B:
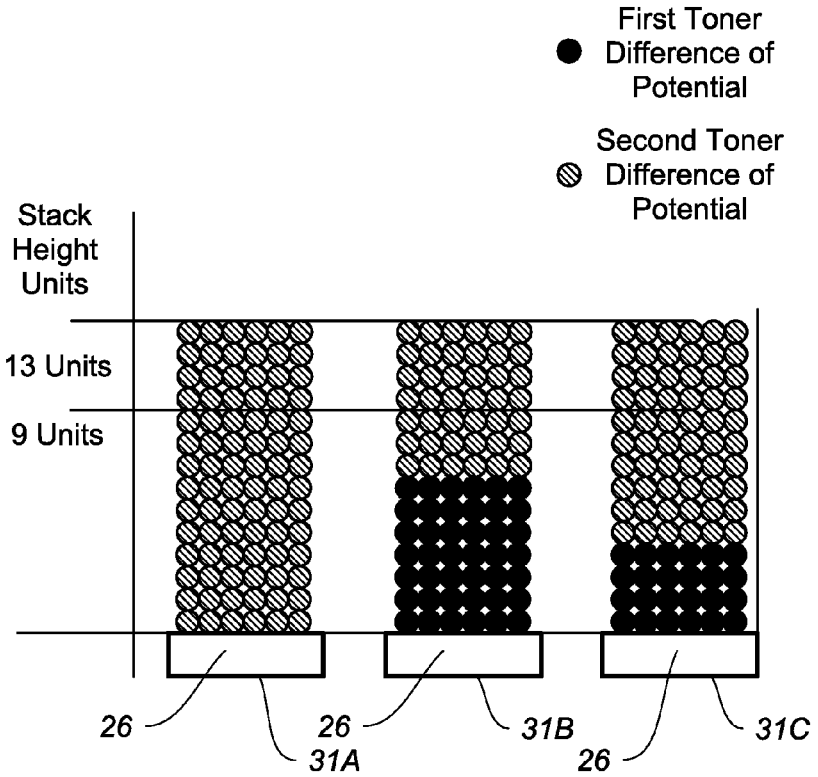

FIGS. 9A-9B conceptually illustrate effects of the method of FIG. 7 at different engine pixel locations to reduce the range of toner stack height variations.

Figure 10A:
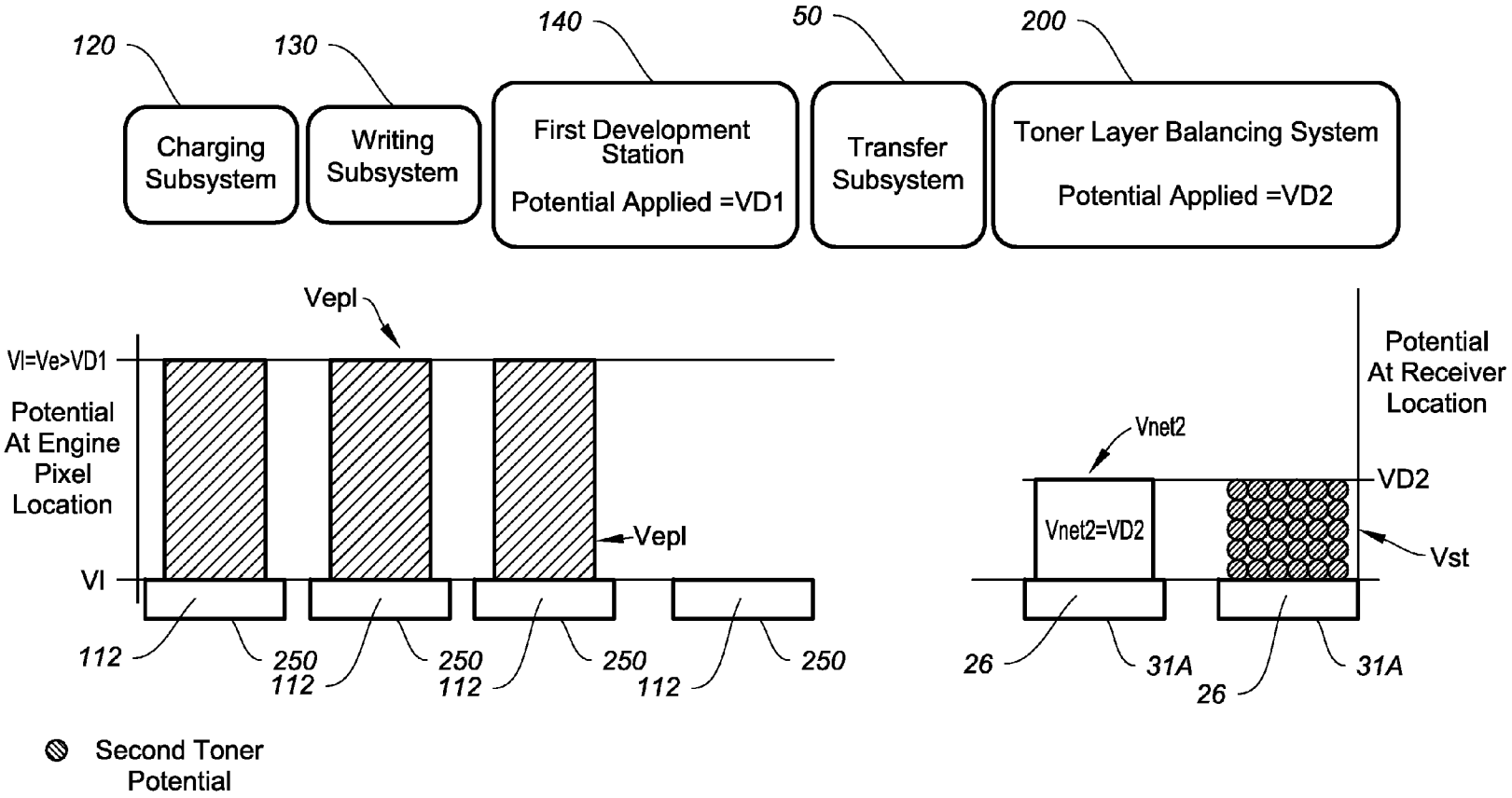
Figure 10B:
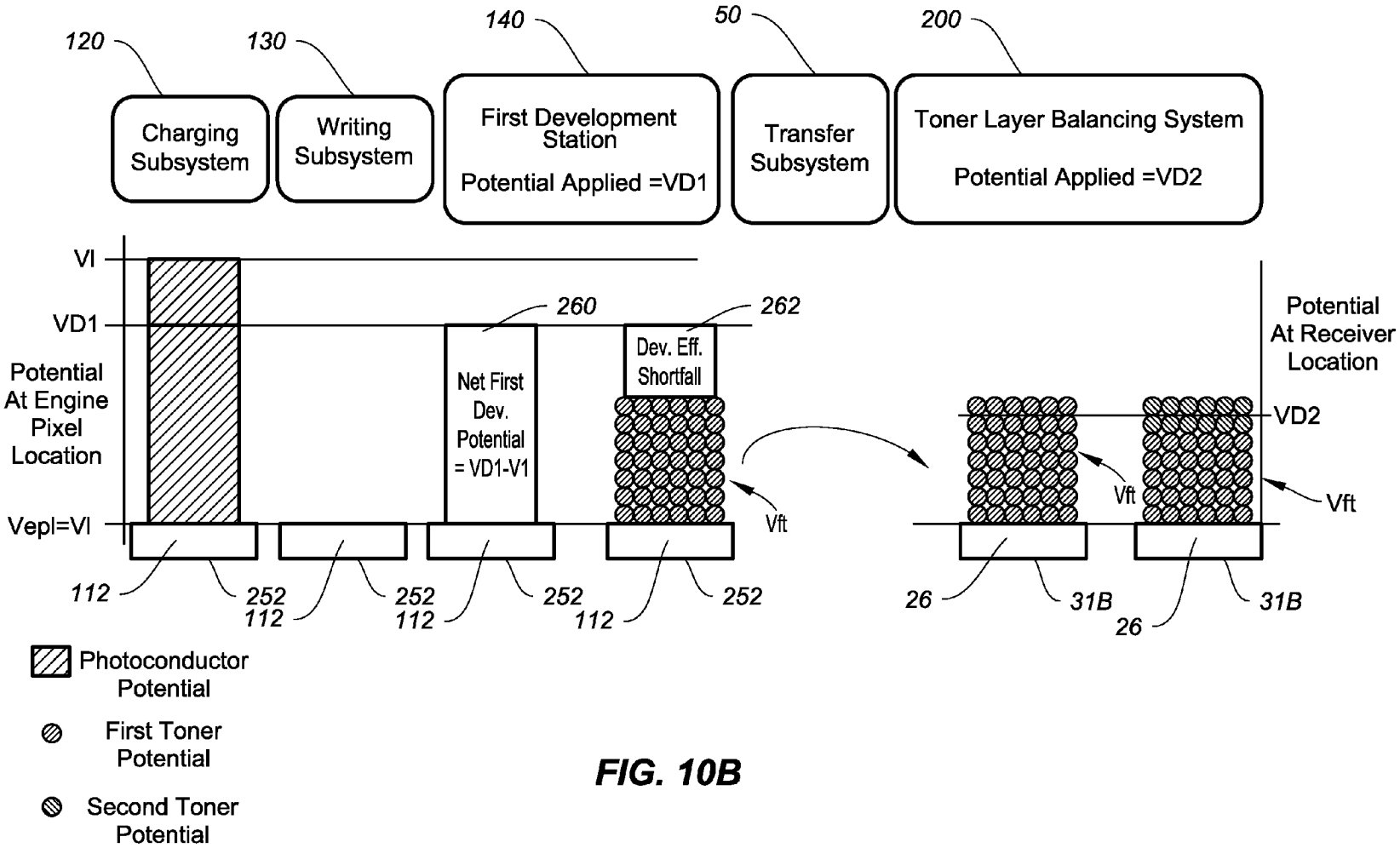
Figure 10C:
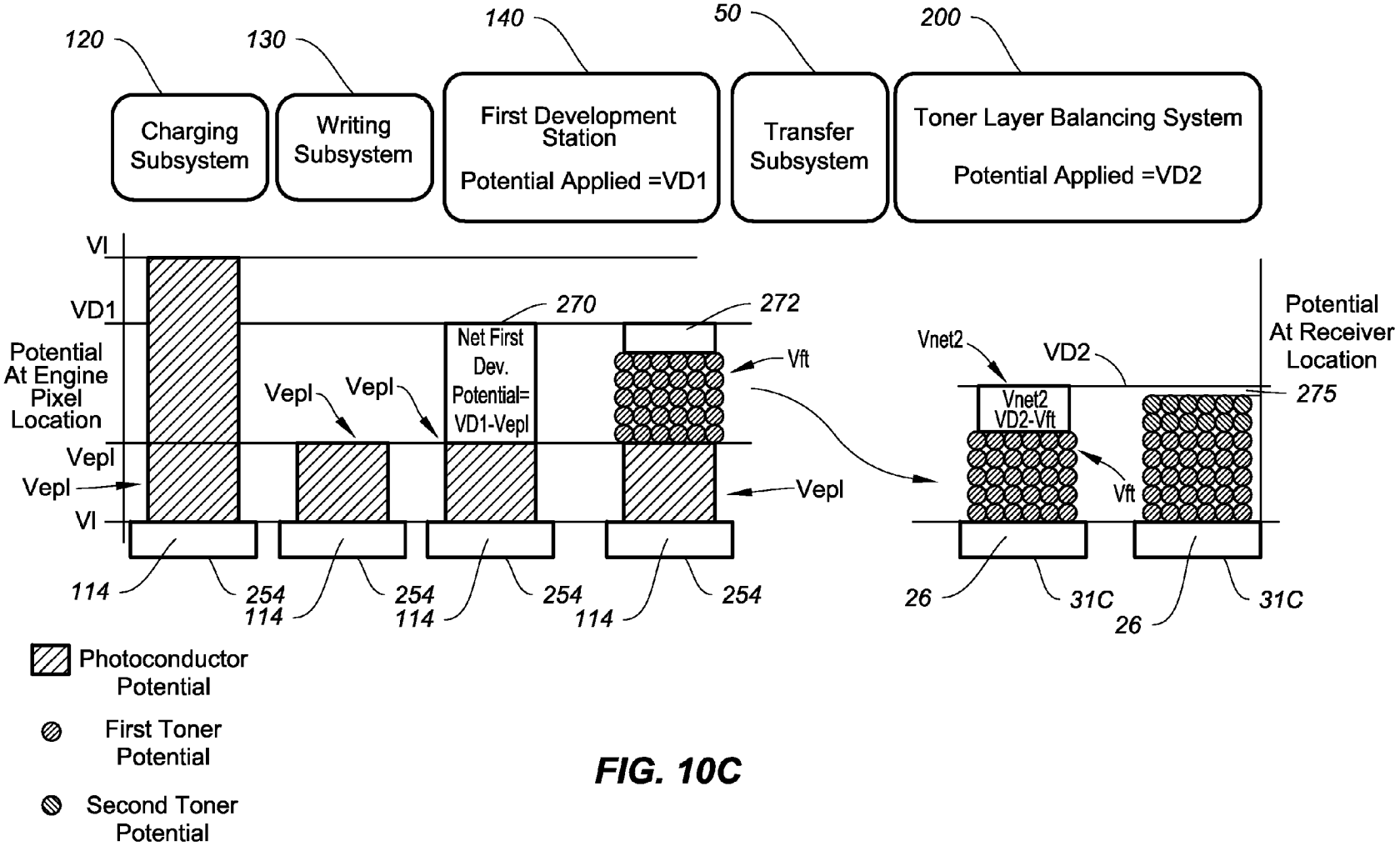

FIGS. 10A-10C provide illustrations depicting the operation of the method of FIG. 7 to provide a toner overcoat of a different amount to reduce the range of stack height variations to a second extent.

Figure 11A:
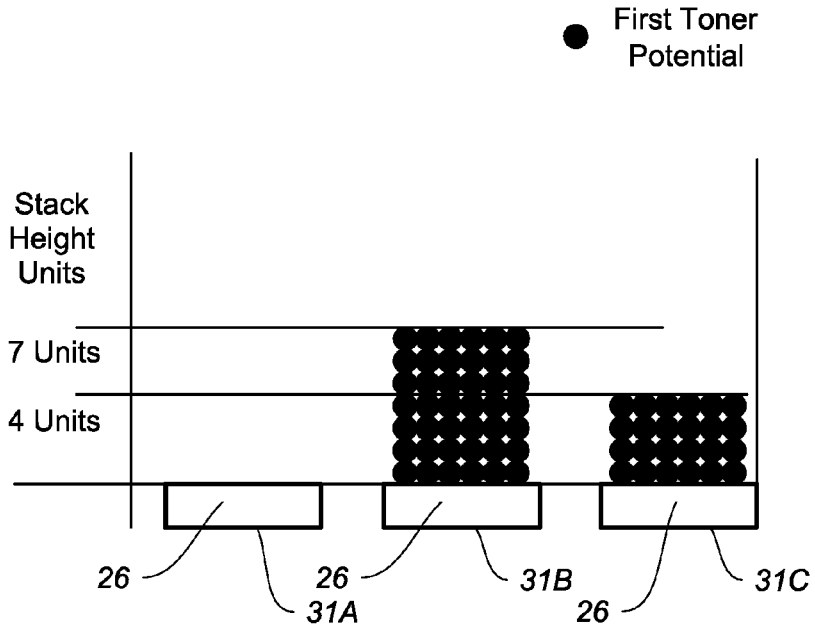
Figure 11B:
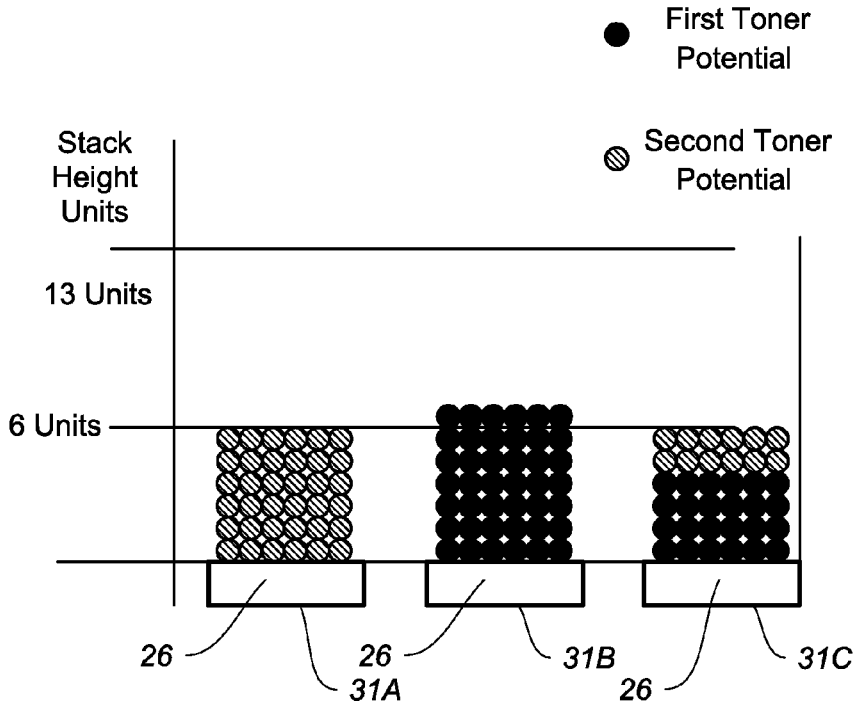

FIGS. 11A-11B conceptually illustrate effects of the method of FIG. 7 at different engine pixel locations to reduce the range of toner stack height variations according to the operation described in FIGS. 10A-10C.

Figure 5:
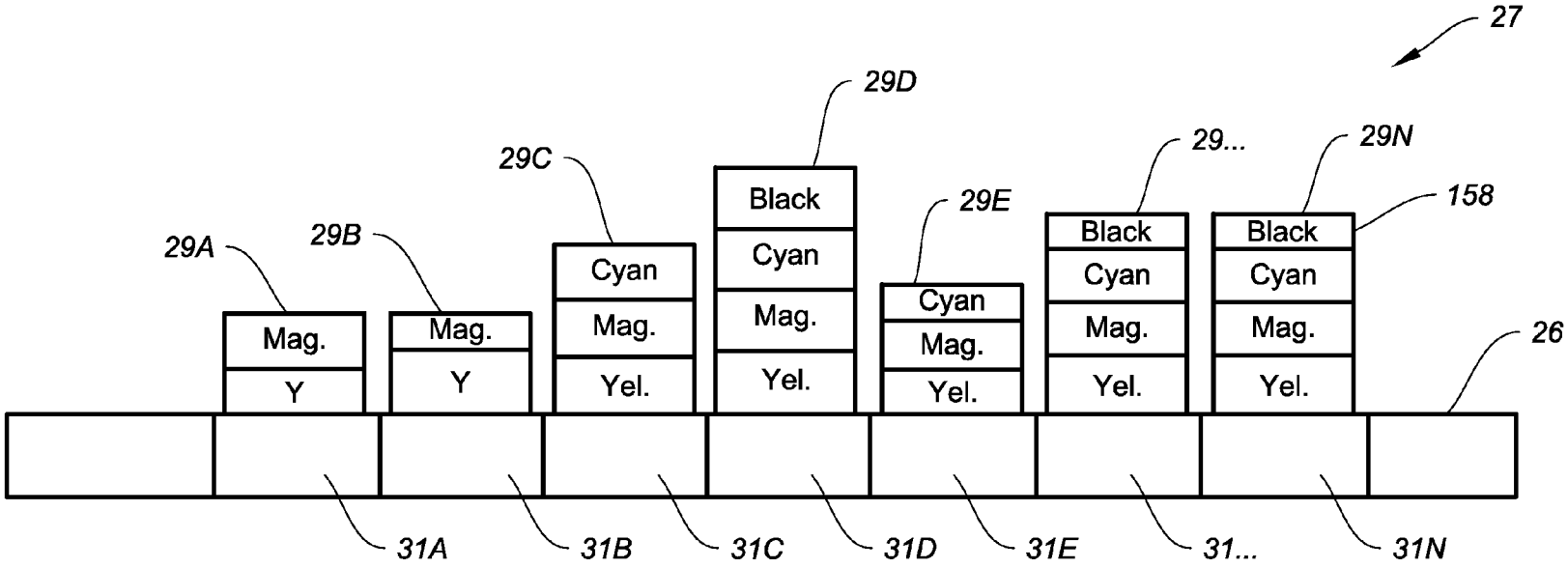
FIG. 5 illustrates one example of a composite toner image.
Figure 12A:
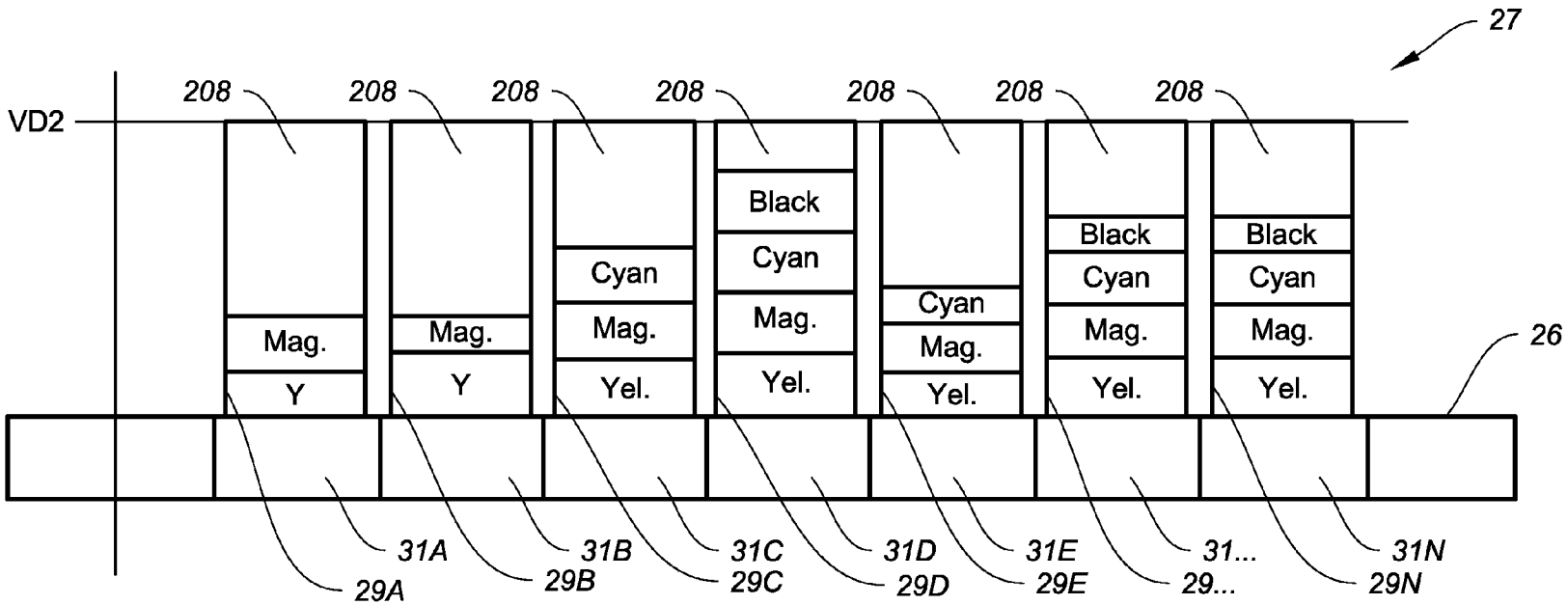
Figure 12B:
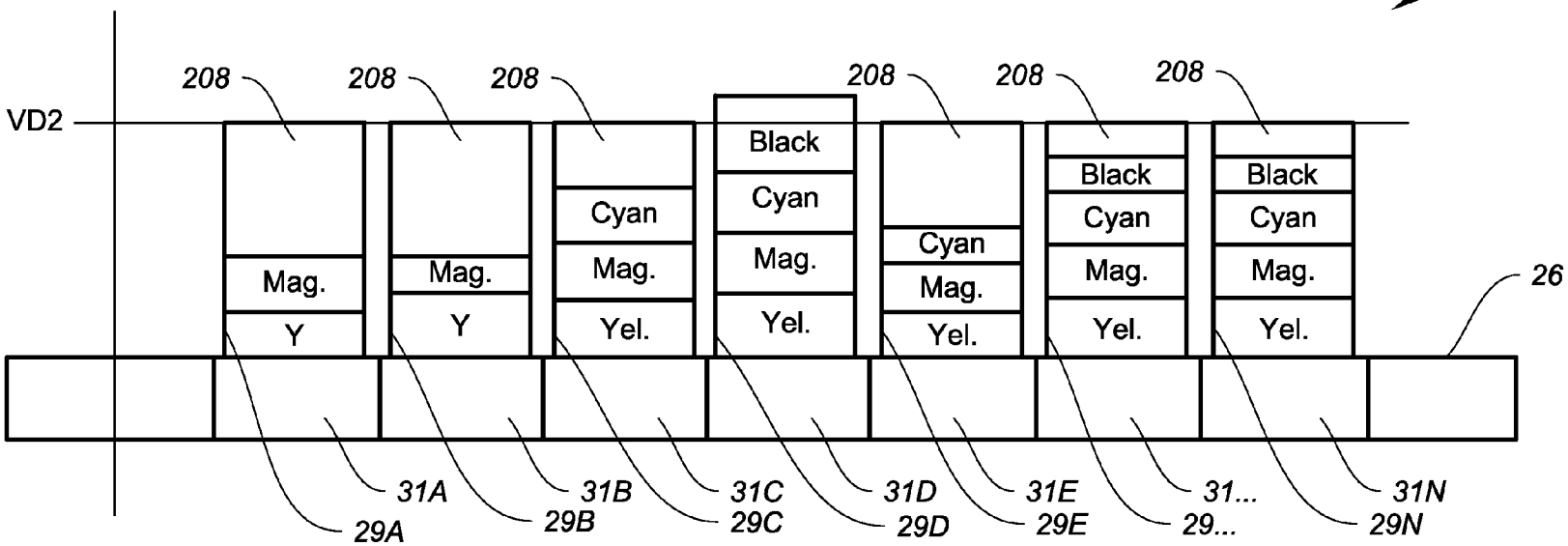

FIGS. 12A and 12B further illustrate the effects of the application of second toner to the composite toner image of shown in FIG. 5 under different toner layer balancing conditions.

DETAILED DESCRIPTION OF THE INVENTION

Figure 1:
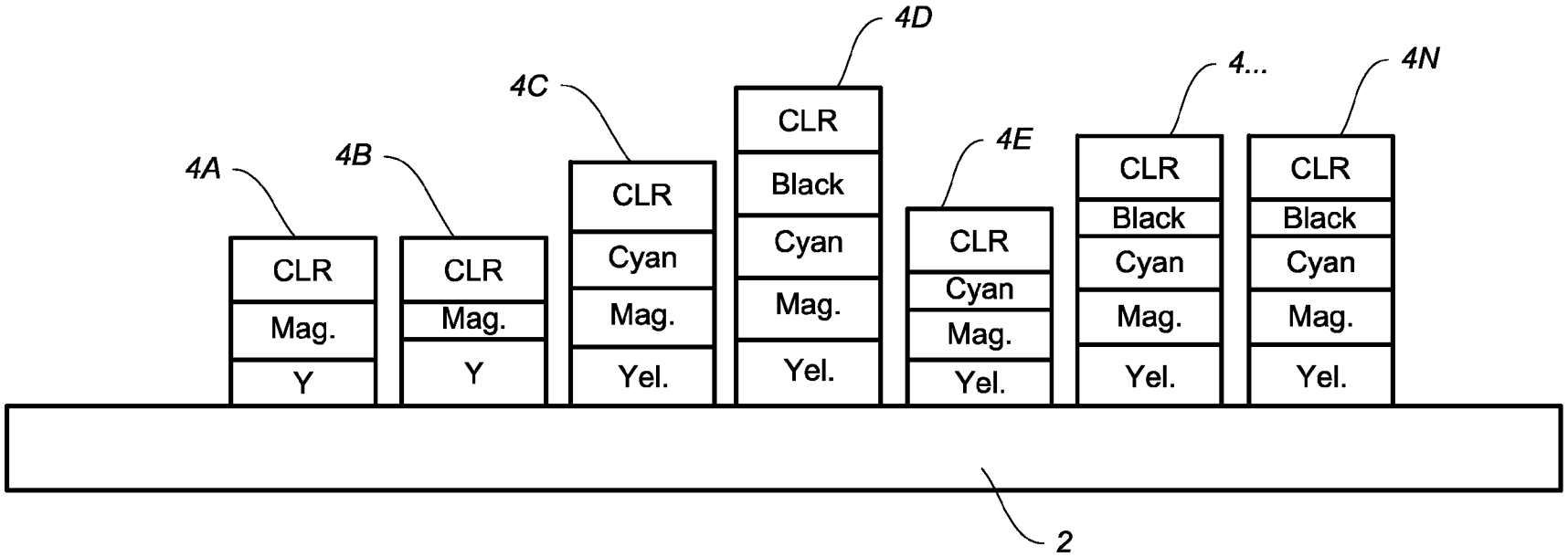
FIG. 1 (Prior Art)
FIG. 1 shows a plurality of color toner stacks on a receiver.
Figure 2:
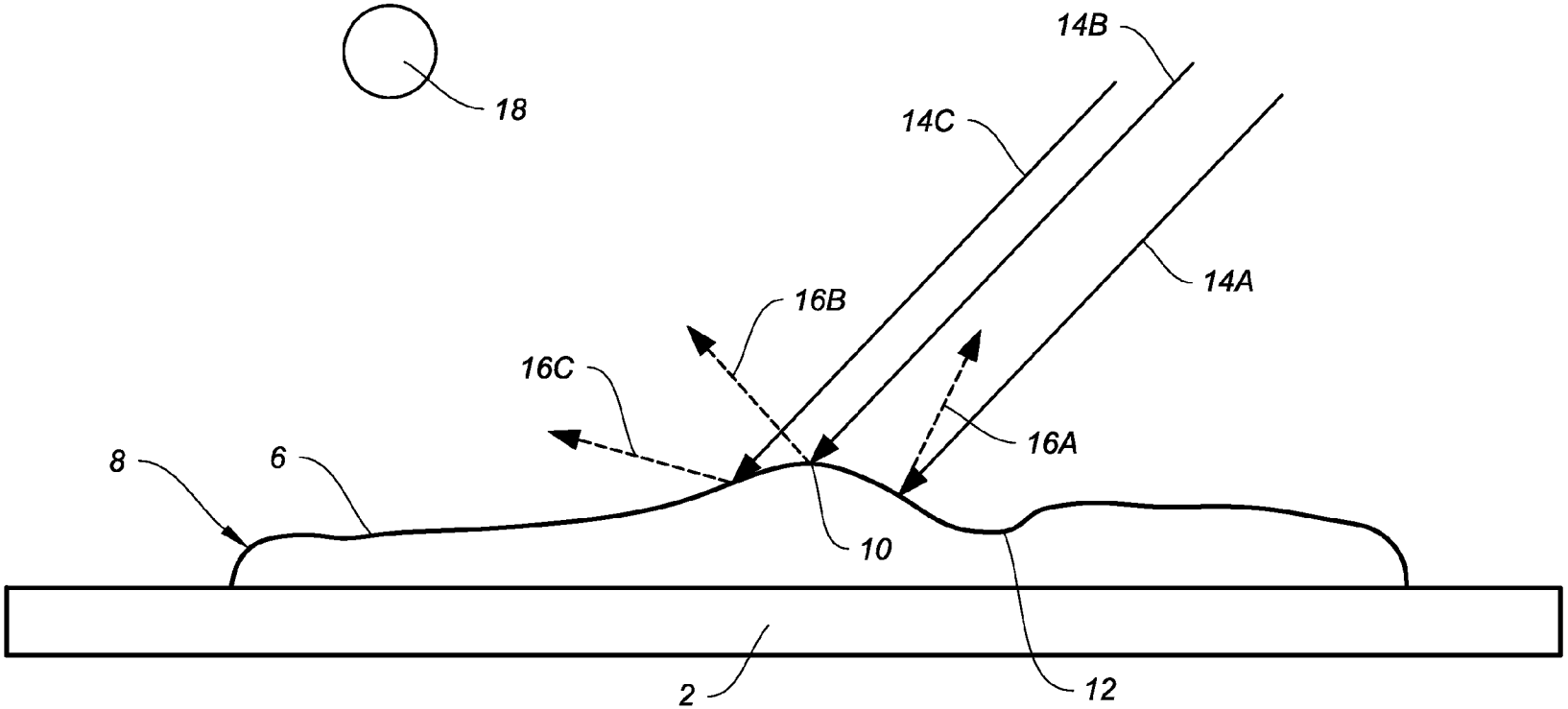
FIG. 2 (Prior Art)
FIG. 2 shows the toner stacks of FIG. 1 in a fused state.
Figure 3:
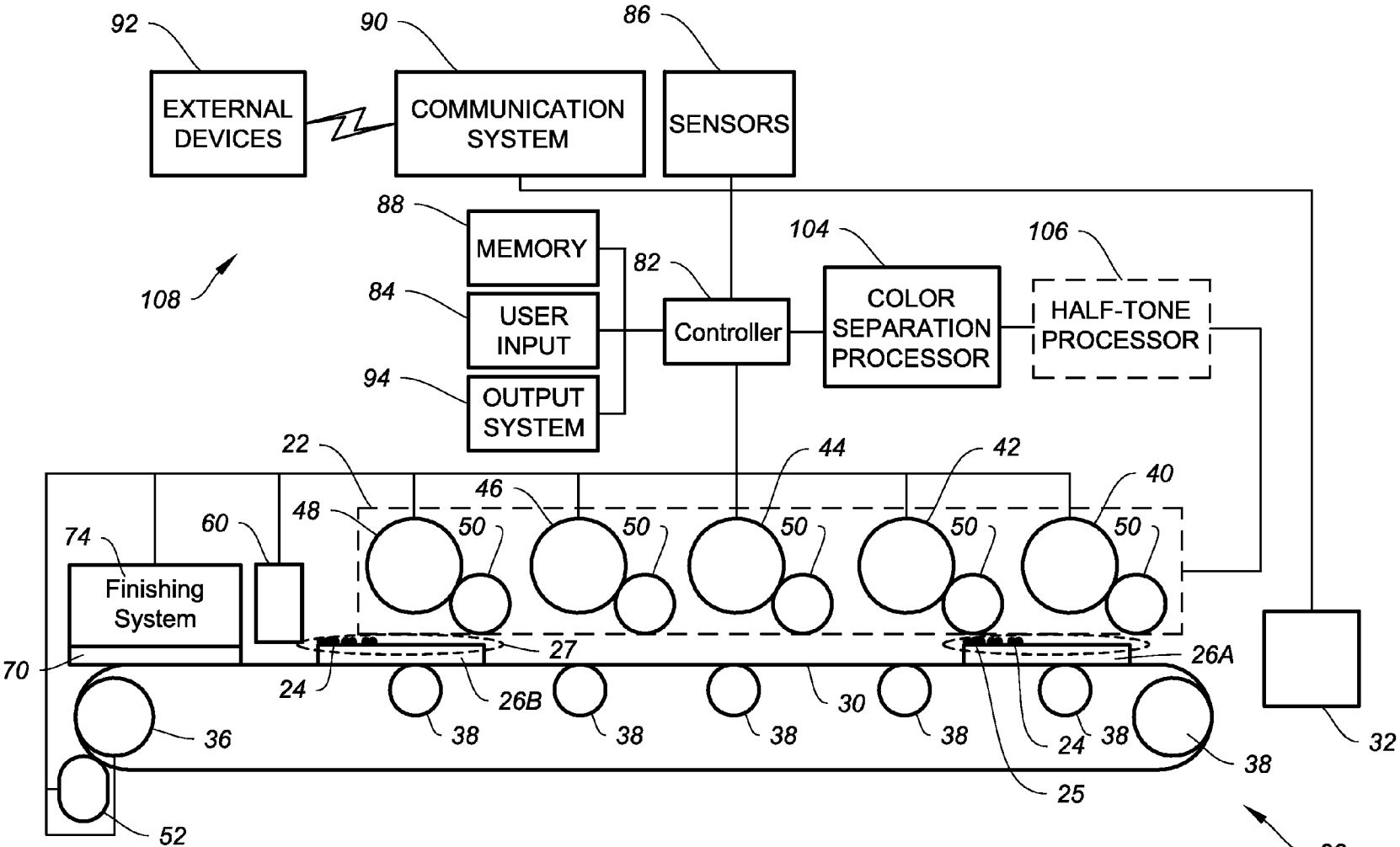
FIG. 3 shows a system level illustration of one embodiment of an electrophotographic printer.

FIG. 3 is a system level illustration of a printer 20. In the embodiment of FIG. 3, printer 20 has a print engine 22 of an electrophotographic type that deposits toner 24 to form a toner image 25 in the form of a patterned arrangement of toner stacks. Toner image 25 can include any patternwise application of toner 24 and can be mapped according to data representing text, graphics, photo, and other types of visual content, as well as patterns that are determined based upon desirable structural or functional arrangements of the toner 24.

Toner 24 is a material or mixture that contains toner particles and that can form an image, pattern, or indicia when electrostatically deposited on an imaging member including a photoreceptor, photoconductor, electrostatically-charged, or magnetic surface. As used herein, "toner particles" are the particles that are electrostatically transferred by print engine 22 to form a pattern of material on a receiver 26A, 26B to convert an electrostatic latent image into a visible image or other pattern of toner 24 on receiver. Toner particles can also include clear particles that have the appearance of being transparent or that while being generally transparent impart a coloration or opacity. Such clear toner particles can provide for example a protective layer on an image or can be used to create other effects and properties on the image. The toner particles are fused or fixed to bind toner 24 to a receiver 26A, 26B.

Toner particles can have a range of diameters, e.g. less than 4 μm, on the order of 5-15 μm, up to approximately 30 μm, or larger. When referring to particles of toner 24, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. Toner 24 is also referred to in the art as marking particles or dry ink. In certain embodiments, toner 24 can also comprise particles that are entrained in a liquid carrier.

Typically, receiver 26A, 26B takes the form of paper, film, fabric, metallicized or metallic sheets or webs. However, receiver 26A, 26B can take any number of forms and can comprise, in general, any article or structure that can be moved relative to print engine 22 and processed as described herein.

Print engine 22 has one or more printing modules, shown in FIG. 3 as printing modules 40, 42, 44, 46, and 48 that are each used to deliver a single application of toner 24 to form a toner image 25 on receiver 26A, 26B. For example, the toner image 25 shown formed on receiver 26A in FIG. 3 can provide a monochrome image or layer of a structure or other functional material or shape.

Print engine 22 and a receiver transport system 28 cooperate to deliver one or more toner image 25 in registration to form a composite toner image 27 such as the one shown formed in FIG. 3 as being formed on receiver 26B. Composite toner image 27 can be used for any of a plurality of purposes, the most common of which is to provide a printed image with more than one color. For example, in a four color image, four toner images are formed each toner image having one of the four subtractive primary colors, cyan, magenta, yellow, and black. These four color toners can be combined to form a representative spectrum of colors. Similarly, in a five color image various combinations of any of five differently colored toners can be combined to form a color print on receiver 26A, 26B. That is, any of the five colors of toner 24 can be combined with toner 24 of one or more of the other colors at a particular location on receiver 26A, 26B to form a color after a fusing or fixing process that is different than the colors of the toners 24 applied at that location.

In FIG. 3, print engine 22 is illustrated as having an optional arrangement of five printing modules 40, 42, 44, 46, and 48, also known as electrophotographic imaging subsystems arranged along a length of receiver transport system 28. Each printing module delivers a single toner image 25 to a respective transfer subsystem 50 in accordance with a desired pattern. The respective transfer subsystem 50 transfers the toner image 25 onto a receiver 26A, 26B as receiver 26A, 26B is moved by receiver transport system 28. Receiver transport system 28 comprises a movable surface 30 that positions receiver 26A, 26B relative to printing modules 40, 42, 44, 46, and 48. In this embodiment, movable surface 30 is illustrated in the form of an endless belt that is moved by motor 36, that is supported by rollers 38, and that is cleaned by a cleaning mechanism 52. However, in other embodiments receiver transport system 28 can take other forms and can be provided in segments that operate in different ways or that use different structures. In an alternate embodiment, not shown, printing modules 40, 42, 44, 46 and 48 can each deliver a single application of toner 24 to a composite transfer subsystem 50 to form a combination toner image thereon which can be transferred to a receiver.

Printer 20 is operated by a printer controller 82 that controls the operation of print engine 22 including but not limited to each of the respective printing modules 40, 42, 44, 46, and 48, receiver transport system 28, receiver supply 32, and transfer subsystem 50, to cooperate to form toner images 25 in registration on a receiver 26A, 26B or an intermediate in order to yield a composite toner image 27 on receiver 26A, 26B and to cause fuser 60 to fuse composite toner image 27 on receiver 26A, 26B to form a print 70 as described herein or otherwise known in the art.

Printer 20 is operated by a printer controller 82 that controls the operation of print engine 22 including but not limited to each of the respective printing modules 40, 42, 44, 46, and 48, receiver transport system 28, receiver supply 32, and transfer subsystem 50, to cooperate to form toner images 25 in registration on a receiver 26 or an intermediate in order to yield a composite toner image 27 on receiver 26 and to cause fuser 60 to fuse composite toner image 27 on receiver 26 to form a print 70 as described herein or otherwise known in the art.

Printer controller 82 operates printer 20 based upon input signals from a user input system 84, sensors 86, a memory 88 and a communication system 90. User input system 84 can comprise any form of transducer or other device capable of receiving an input from a user and converting this input into a form that can be used by printer controller 82. Sensors 86 can include contact, proximity, electromagnetic, magnetic, or optical sensors and other sensors known in the art that can be used to detect conditions in printer 20 or in the environment-surrounding printer 20 and to convert this information into a form that can be used by printer controller 82 in governing printing, fusing, finishing or other functions.

Memory 88 can comprise any form of conventionally known memory devices including but not limited to optical, magnetic or other movable media as well as semiconductor or other forms of electronic memory. Memory 88 can contain for example and without limitation image data, print order data printing instructions, suitable tables and control software that can be used by printer controller 82.

Communication system 90 can comprise any form of circuit, system or transducer that can be used to send signals to or receive signals from memory 88 or external devices 92 that are separate from or separable from direct connection with printer controller 82. External devices 92 can comprise any type of electronic system that can generate signals bearing data that may be useful to printer controller 82 in operating printer 20.

Printer 20 further comprises an output system 94, such as a display, audio signal source or tactile signal generator or any other device that can be used to provide human perceptible signals by printer controller 82 to feedback, informational or other purposes.

Printer 20 prints images based upon print order information. Print order information can include image data for printing and printing instructions from a variety of sources. In the embodiment of FIG. 3, these sources include memory 88, communication system 90, that printer 20 can receive such image data through local generation or processing that can be executed at printer 20 using, for example, user input system 84, output system 94 and printer controller 82. Print order information can also be generated by way of remote input 56 and local input 66 and can be calculated by printer controller 82. For convenience, these sources are referred to collectively herein as source of print order information 108. It will be appreciated, that this is not limiting and that source of print order information 108 can comprise any electronic, magnetic, optical or other system known in the art of printing that can be incorporated into printer 20 or that can cooperate with printer 20 to make print order information or parts thereof available.

In the embodiment of printer 20 that is illustrated in FIG. 3, printer controller 82 has a color separation image processor 104 to convert the image data into color separation images that can be used by printing modules 40-48 of print engine 22 to generate toner images. An optional half-tone processor 106 is also shown that can process the color separation images according to any half-tone screening requirements of print engine 22.

Figure 4A:
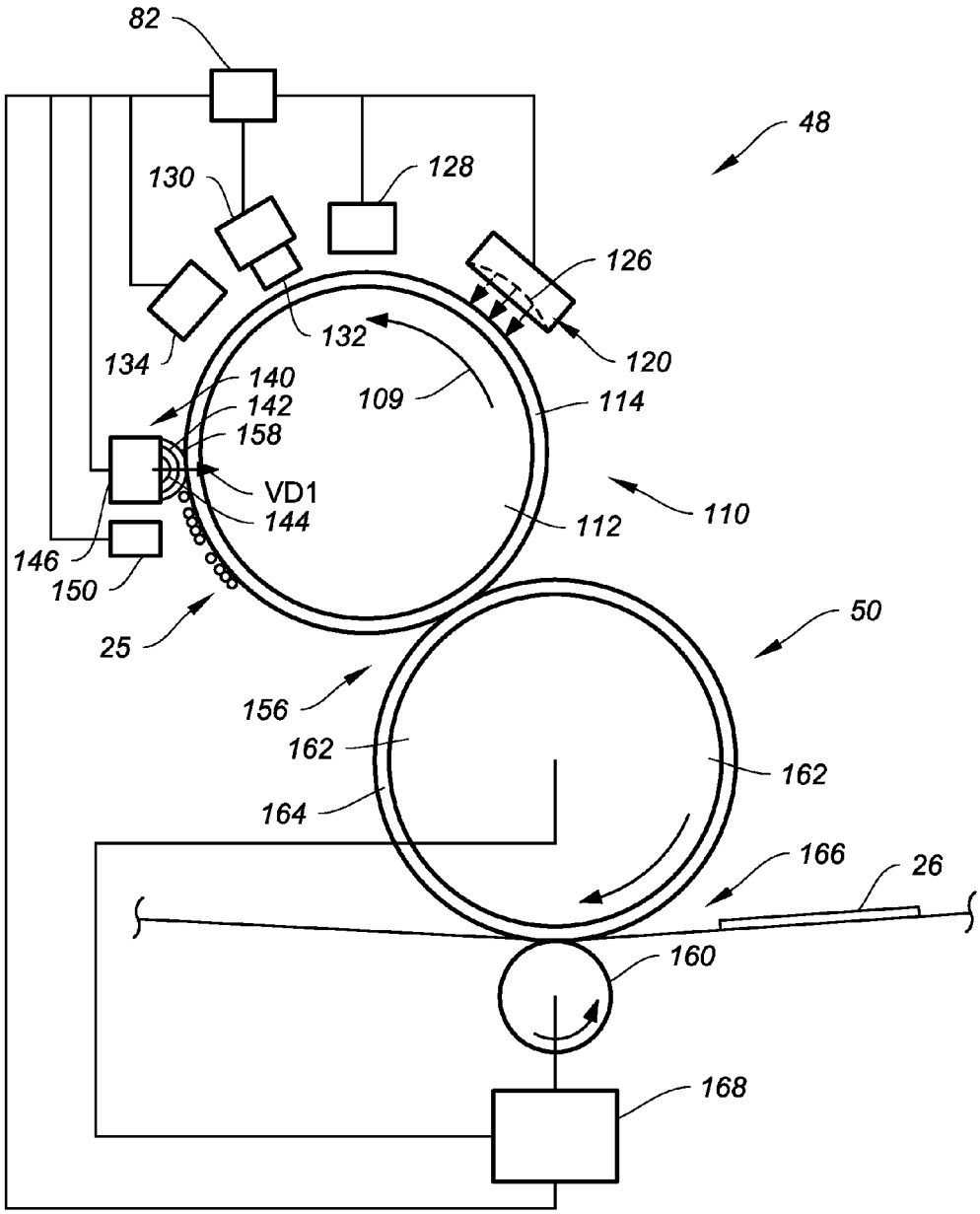
FIG. 4A-4C illustrates one embodiment of a printing module.
Figure 4B:
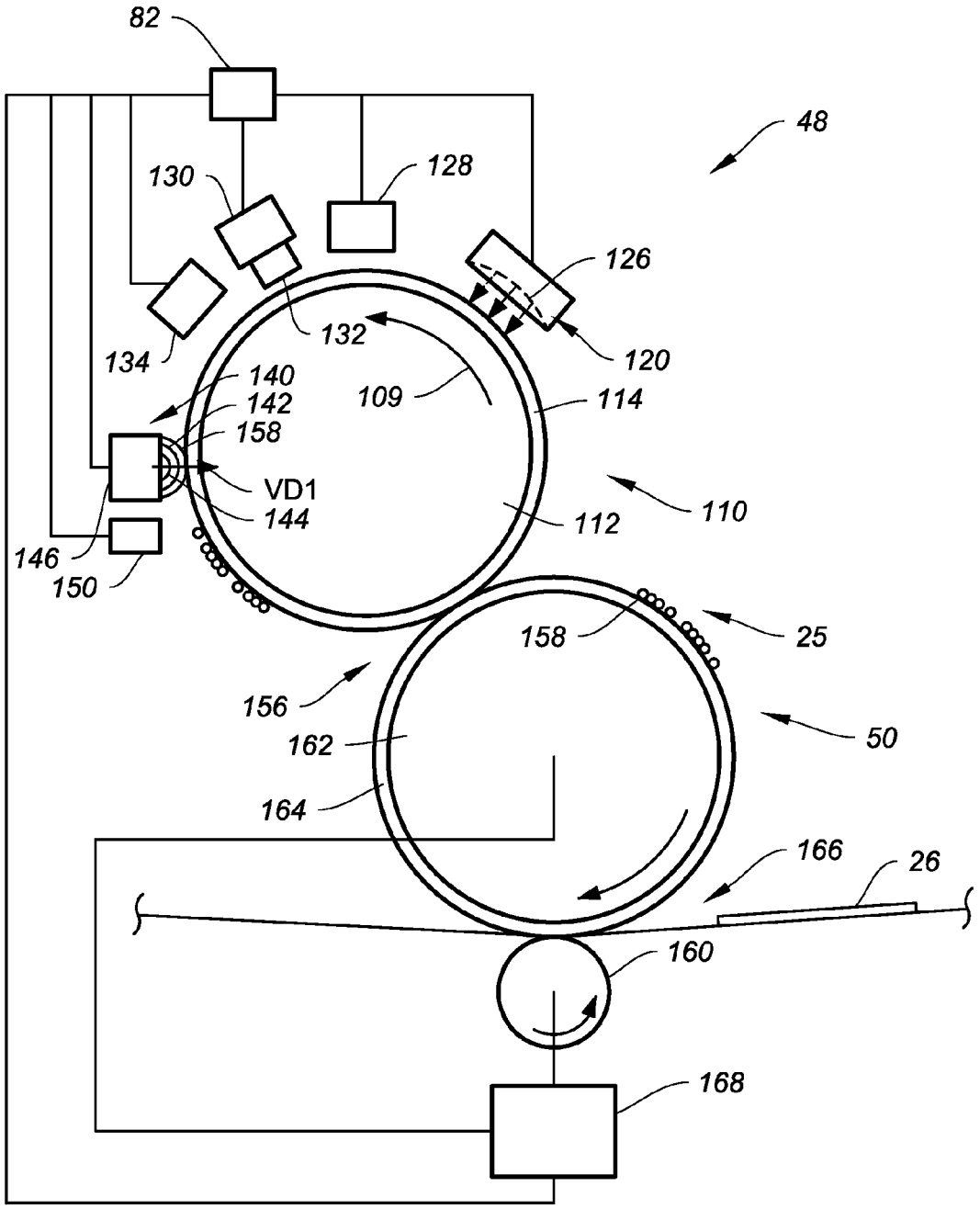
Figure 4C:
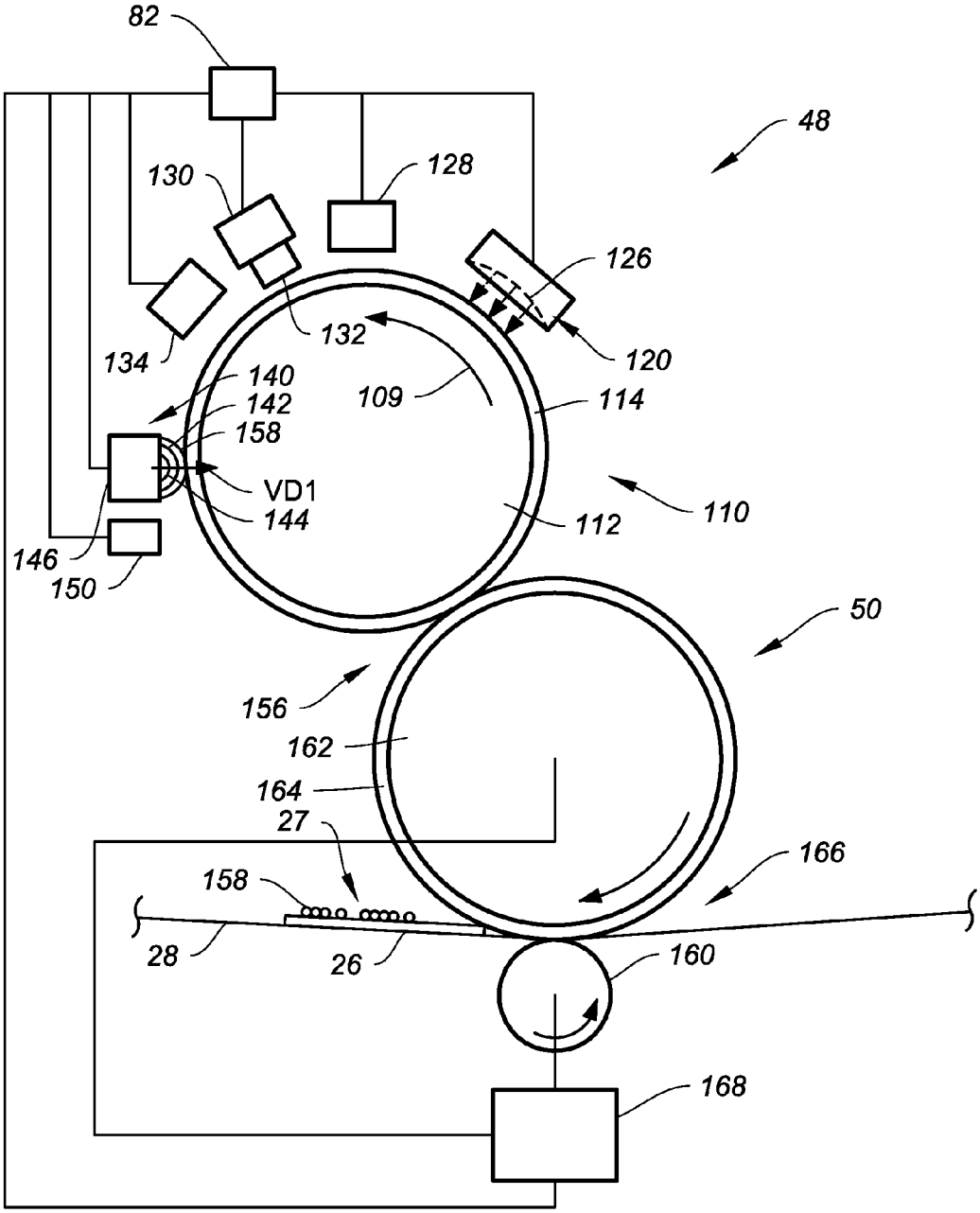

FIGS. 4A-4C shows more details of an example of a printing module 48 representative of printing modules 40, 42, 44, and 46 of FIG. 3. In this embodiment, printing module 48 has a primary imaging system 110, a charging subsystem 120, a writing subsystem 130 and a first development station that are each ultimately responsive to printer controller 82. Each printing module can also have its own respective local controller (not shown) or hardwired control circuits (not shown) to perform local control and feedback functions for an individual module or for a subset of the printing modules. Such local controllers or local hardwired control circuits are coupled to printer controller 82.

Primary imaging system 110 includes a primary imaging member 112. In the embodiment of FIGS. 4A-4C, primary imaging member 112 takes the form of an imaging cylinder. However, in other embodiments primary imaging member 112 can take other forms, such as a belt or plate. As is indicated by arrow 109 in FIGS. 4A-4C, primary imaging member 112 is rotated by a motor (not shown) such that primary imaging member 112 rotates from charging subsystem 120, to writing subsystem 130, to first development station 140 and into a transfer nip 156 with a transfer subsystem 50.

In the embodiment of FIGS. 4A-4C, primary imaging member 112 has a photoreceptor 114. Photoreceptor 114 includes a photoconductive layer formed on an electrically conductive substrate. The photoconductive layer is an insulator in the substantial absence of light so that initial differences of potential Vi can be retained on its surface. Upon exposure to light, the charge of the photoreceptor in the exposed area is dissipated in whole or in part as a function of the amount of the exposure. In various embodiments, photoreceptor 114 is part of, or disposed over, the surface of primary imaging member 112. Photoreceptor layers can include a homogeneous layer of a single material such as vitreous selenium or a composite layer containing a photoconductor and another material. Photoreceptor layers can also contain multiple layers.

Charging subsystem 120 is configured as is known in the art, to apply charge to photoreceptor 114. The charge applied by charging subsystem 120 creates a generally uniform initial difference of potential Vep1 relative to ground. The initial difference of potential Vep1 has a first polarity which can, for example, be a negative polarity. Here, charging subsystem 120 includes a grid 126 that is selected and driven by a power source (not shown) to charge photoreceptor 114. Other charging systems can also be used.

In this embodiment, an optional meter 128 is provided that measures the electrostatic charge on photoreceptor 114 after initial charging and that provides feedback to, in this example, printer controller 82, allowing printer controller 82 to send signals to adjust settings of the charging subsystem 120 to help charging subsystem 120 to operate in a manner that creates a desired initial difference of potential Vi on photoreceptor 114. In other embodiments, a local controller or analog feedback circuit or the like can be used for this purpose.

Writing subsystem 130 is provided having a writer 132 that forms charge patterns on a primary imaging member 112. In this embodiment, this is done by exposing primary imaging member 112 to electromagnetic or other radiation that is modulated according to color separation image data to form a latent electrostatic image (e.g., of a color separation corresponding to the color of toner deposited at printing module 48) and that causes primary imaging member 112 to have image modulated charge patterns thereon.

In the embodiment shown in FIGS. 4A-4C, writing subsystem 130 exposes the uniformly-charged photoreceptor 114 of primary imaging member 112 to actinic radiation provided by selectively activating particular light sources in an LED array or a laser device outputting light directed at photoreceptor 114. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time. While various embodiments described herein describe the formation of an imagewise modulated charge pattern on a primary imaging member 112 by using a photoreceptor 114 and optical type writing subsystem 130, such embodiments are exemplary and any other systems, methods, or apparatuses known in the art for forming an imagewise modulated pattern differences of potential on a primary imaging member 112 consistent with what is described or claimed herein can be used for this purpose.

As used herein, an "engine pixel" is the smallest addressable unit of primary imaging system 110 or in this embodiment on photoreceptor 114 which writer 132 (e.g., a light source, laser or LED) can expose with a selected exposure different from the exposure of another engine pixel. Engine pixels can overlap, e.g., to increase addressability in the slow-scan direction (S). Each engine pixel has a corresponding engine pixel location on an image and the exposure applied to the engine pixel location is described by an engine pixel level. The engine pixel level is determined based upon the density of the color separation image being printed by printing module 48.

Writing subsystem 130 is a write-black or discharged-area development (DAD) system where image wise modulation of the primary imaging member 112 is performed according to a model under which a toner is charged to have the same first polarity as the charge on primary imaging member 112. As is used herein difference of potential refers to a difference of potential between the cited member and ground unless otherwise specified as the difference of potential between two members. In the DAD system, the charged toner is urged to primary imaging member 112 by a net difference of potential between a first development station 140 and engine pixel locations on a the primary imaging member 112 during development. In the embodiment of FIGS. 4A-4C this difference of potential varies based on the difference of potential at each engine pixel location. Toner of the same potential is urged to deposit onto engine pixel locations on the primary imaging member 112 where the difference of potential of an engine pixel location Vep1 of primary imaging member 112 has been modulated from the initial difference of potential Vi to a lower engine pixel level Vep1. The magnitude of the difference of potential an engine pixel location Vep1 inversely corresponds to the engine pixel level for the engine pixel location.

Accordingly, in a DAD system, toner develops on the primary imaging member 112 at engine pixel locations that have an image modulated difference of potential Vep1 that is lower than a development difference of potential and does not develop on the primary imaging member 112 at locations that have a difference of potential Vep1 that is greater than a development difference of potential used to develop a toner at such locations. It will be appreciated that, in this regard, any or all of printer controller 82, color separation processor 104 and half tone processor 106 process image information and printing instructions in ways that cause image modulated differences of potential to be generated according to this DAD model.

Engine pixel locations having image modulated potentials that are less than a development difference of potential therefore correspond to areas of primary imaging member 112 onto which toner will be deposited during development while areas having an image modulated difference of potential that is above the development difference of potential are not developed with toner.

After writing, primary imaging member 112 has an image modulated difference of potential at each engine pixel location Vep1 that varies between a higher difference of potential Vh that can be at or less than the initial difference of potential Vi reflecting in this embodiment, a difference of potential at an engine pixel location that has not been exposed, and that can be above a lower level V1 reflecting in this embodiment a lower potential at an engine pixel location that has been exposed by an exposure at an upper range of available exposure settings.

Another meter 134 is optionally provided in this embodiment and measures charge within a non-image test patch area of photoreceptor 114 after the photoreceptor 114 has been exposed to writer 132 to provide feedback related to differences of potential created using between writer 132 and photoreceptor 114. Other meters and components (not shown) can be included to monitor and provide feedback regarding the operation of other systems described herein so that appropriate control can be provided.

First development station 140 has a first toning shell 142 that provides a first developer having a first toner 158 near primary imaging member 112. First toner 158 is charged and has the same polarity as the initial charge Vi on primary imaging member 112 and as any image modulated difference of potential Vep1 of the engine pixel locations on primary imaging member 112. First development station 140 also has a first supply system 146 for providing charged first toner 158 to first toning shell 142 and a first power supply 150 for providing a bias for first toning shell 142. First supply system 146 can be of any design that maintains or that provides appropriate levels of charged first toner 158 at first toning shell 142 during development. Similarly, first power supply 150 can be of any design that can maintain the bias described herein. In the embodiment illustrated here, first power supply 150 is shown optionally connected to printer controller 82 which can be used to control the operation of first power supply 150.

The bias at first toning shell 142 creates a first development difference of potential VD1 of the first polarity relative to ground. The first development difference of potential VD1 forms a first net development difference of potential Vnet1 between first toning shell 142 and individual engine pixel locations on primary imaging member 112. The first net development difference of potential Vnet1 is the first development difference of potential VD1 less any image modulated difference of potential Vep1 at the engine pixel location.

First toner 158 on first toning shell 142 develops on individual engine pixel locations of primary imaging member 112 in amounts according to the first net development difference of potential Vnet1. These amounts can, for example, increase along with increases in the first net development difference of potential Vnet1 for each individual engine pixel location and such increases can occur monotonically with increases in the first net development difference of potential Vnet1 Such development produces a first toner image 25 on primary imaging member 112 having first toner quantities associated with engine pixel locations that correspond to the engine pixel levels at the engine pixel locations.

The electrostatic forces that cause first toner 158 to deposit onto primary imaging member 112 can include Coulombic forces between charged toner particles and the charged electrostatic latent image, and Lorentz forces on the charged toner particles due to the electric field produced by the bias voltages.

In one example embodiment, first development station 140 employs a two-component developer that includes toner particles and magnetic carrier particles. In this embodiment, first development station 140 includes a magnetic core 144 to cause the magnetic carrier particles near first toning shell 142 to form a "magnetic brush," as known in the electrophotographic art. Magnetic core 144 can be stationary or rotating, and can rotate with a speed and direction the same as or different than the speed and direction of first toning shell 142. Magnetic core 144 can be cylindrical or non-cylindrical, and can include a single magnet or a plurality of magnets or magnetic poles disposed around the circumference of magnetic core 144. Alternatively, magnetic core 144 can include an array of solenoids driven to provide a magnetic field of alternating direction. Magnetic core 144 preferably provides a magnetic field of varying magnitude and direction around the outer circumference of first toning shell 142. Further details of magnetic core 144 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. In other embodiments, first development station 140 can also employ a mono-component developer comprising toner, either magnetic or non-magnetic, without separate magnetic carrier particles. In further embodiments, first development station 140 can take other known forms that can perform development in any manner that is consistent with what is described and claimed herein.

As is shown in FIG. 4B, in this embodiment, after a first toner image 25 is formed, rotation of primary imaging member 112 causes first toner image 25 to move into a first transfer nip 156 between primary imaging member 112 and a transfer subsystem 50 where an intermediate transfer member 162 receives toner image 25. As is shown in FIG. 4C, intermediate transfer member 162 then rotates to move first toner image 25 to a second transfer nip 166 where a receiver 26 receives first toner image 25. In this embodiment, transfer subsystem 50 includes transfer backup member 160 opposite transfer member 162 at second transfer nip 166. Receiver transport system 28 passes at least in part through transfer nip 166 to position receiver 26 to receive toner image 25. In this embodiment, intermediate transfer member 162 is shown having an optional compliant transfer surface 164.

Once that toner image 25 has deposited on primary imaging member 112 or onto intermediate transfer member 162, adhesion forces such as van der Waals forces resist separation of toner image 25 from these members unless another force is provided that overcomes these adhesion forces. In the embodiment of FIG. 4A, the difference of potential Vft of first toner 158 is used to allow such force to be applied to toner image 25 to enable toner image 25 to overcome the adhesion forces and to transfer onto intermediate transfer member 162 and later to enable transfer from intermediate transfer member 162 and on to a receiver 26. As is illustrated in the embodiment of FIGS. 4A-4C, a transfer power supply 168 is shown in FIGS. 4A-4C that creates a difference of potential between primary imaging member 112, and a difference of potential between transfer member 162 and transfer backup member 160. These differences in potential are used to cause toner image 25 to transfer from primary imaging member 112 to intermediate transfer member 162 and to transfer from the intermediate transfer member 162 to the receiver 26.

Returning to FIG. 3, it will understood that printer controller 82 causes one or more of individual printing modules 40, 42, 44, 46 and 48 to generate a toner image 25 of a single color of toner for transfer by respective transfer subsystems 50 to receiver 26A, 26B in registration to form a composite toner image 27.

FIG. 5 illustrates one example of such a composite toner image 27. In this example, composite toner image 27 has different colors of imagewise applied first toner 158 arranged in toner stacks 29A, 29B, 29C, 29D, 29E, 29 . . . to 29N at locations 31A-31N on receiver 26. In this example, each toner stack 29A, 29B, 29C, 29D, 29E, 29 . . . to 29*n* has imagewise applied toner applied in a sequence including yellow, magenta, cyan and black. Accordingly, printing module 40 applies yellow toner to a receiver 26, printing module 42 applies a magenta toner, printing module 44 applies a cyan toner, and printing module 46 applies a black toner. Printing module 48 can apply a supplemental or special effect toner.

In this example, the amount of each color of first toner 158 provided at any of the toner stacks 29A, 29B, 29C, 29D, 29E, 29 . . . to 29*n* can vary according to the color required at their respective locations 31A-31N and as a function of development efficiency shortfalls that occur during the development of each first toner 158. The amount of first toner 158 at each of locations 31A-31N is generally proportional to the toner stack heights of the toner stacks 29A-29N thus the variations in the amount of imagewise applied first toner 158 in the toner stacks of composite toner image 27 can cause variations in toner stack heights that, for the reasons discussed above, reduce the gloss performance of composite toner image 27 after fusing.

Toner Layer Balancing System

Figure 6A:
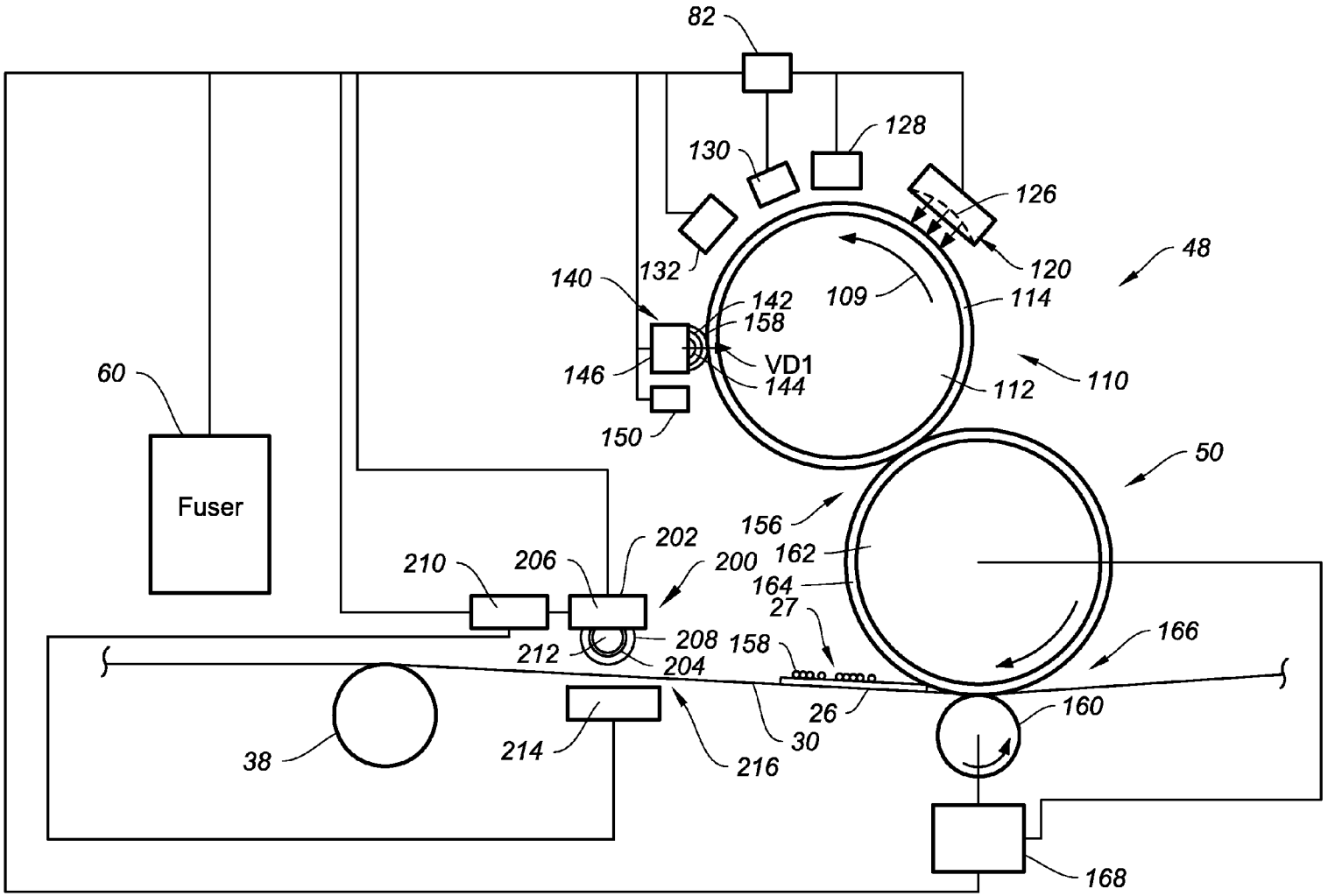
FIGS. 6A-6C illustrate one embodiment of an inverse masking system.
Figure 6B:
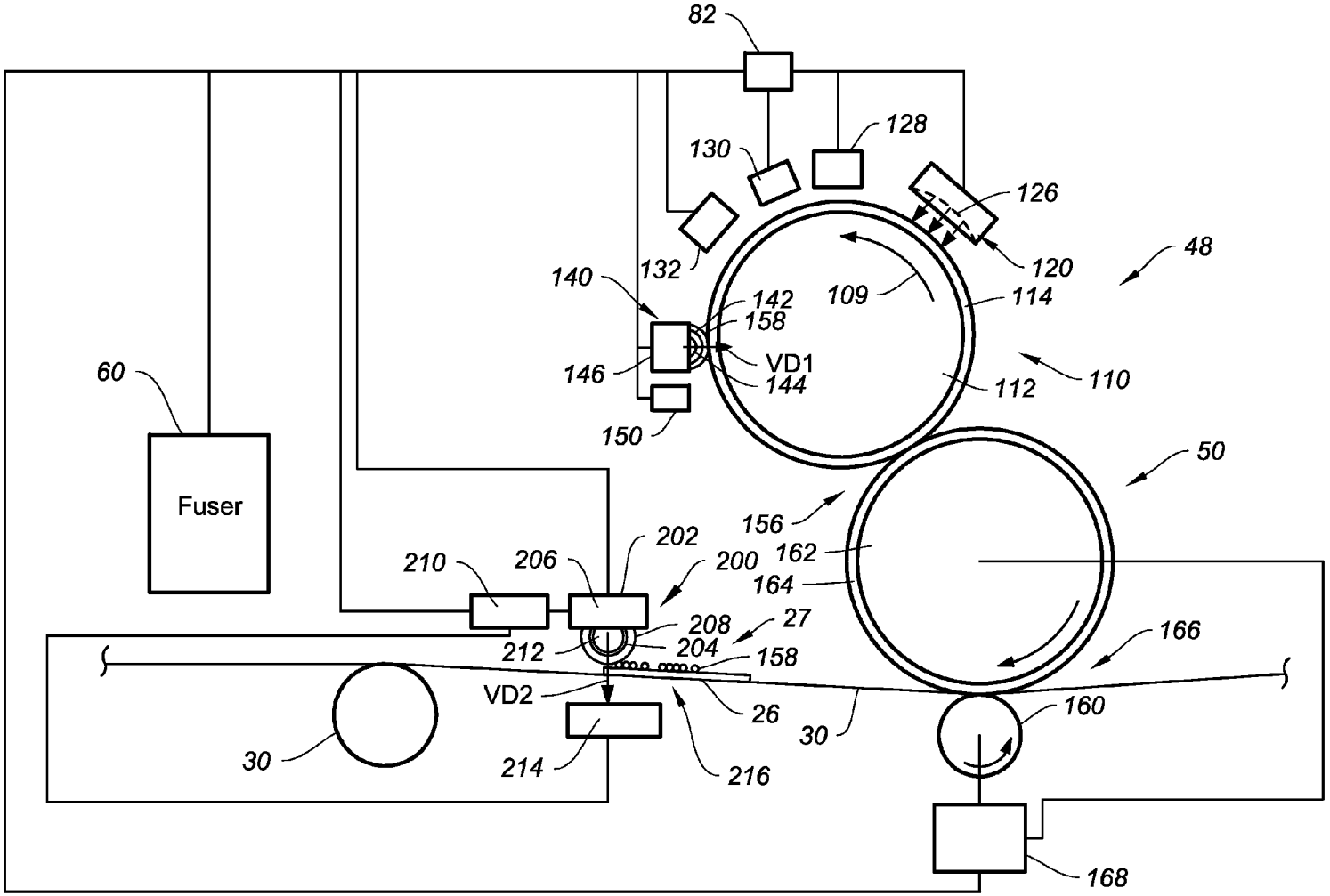
Figure 6C:
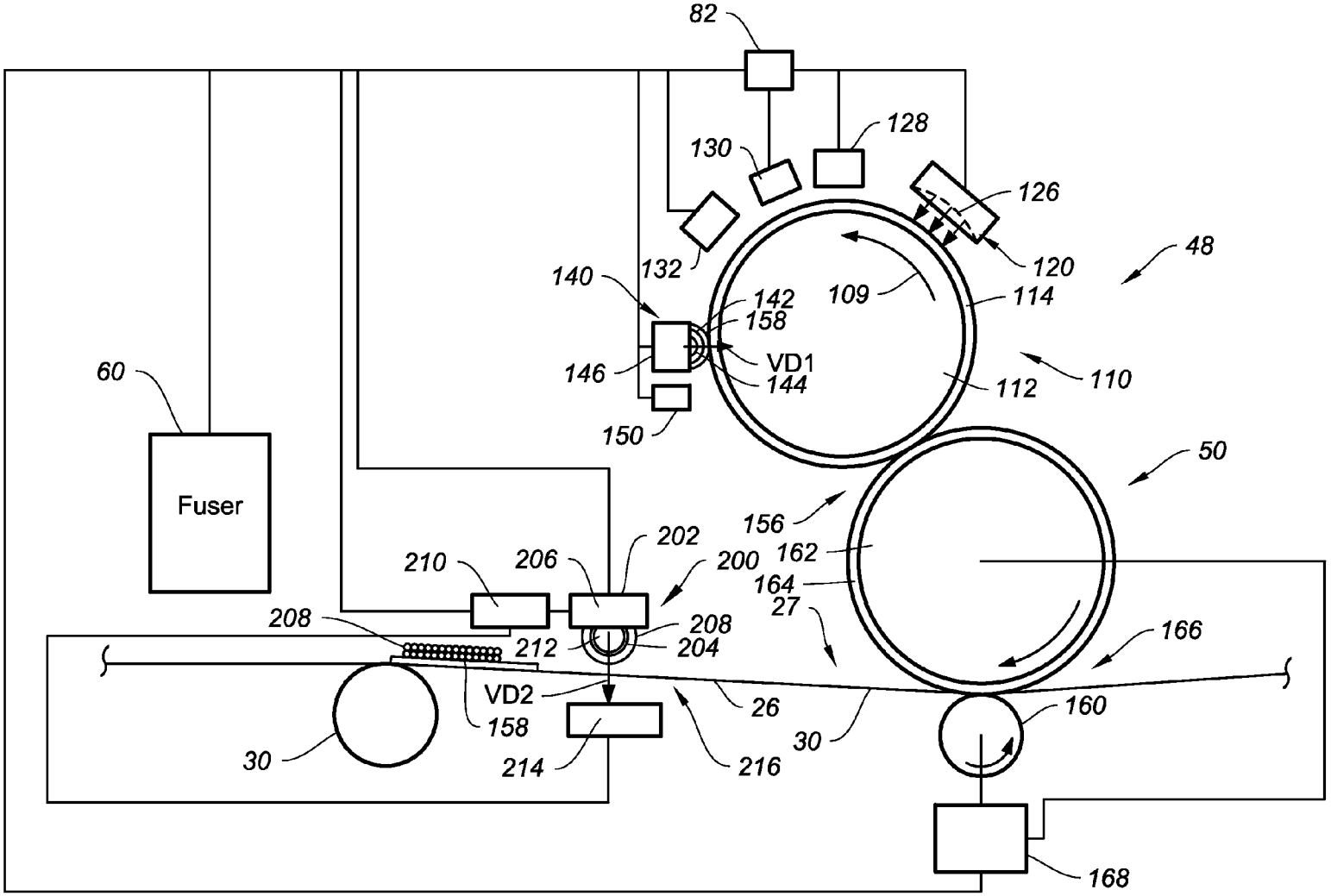

FIGS. 6A-6C show a first embodiment of a toner layer balancing system 200 used to provide a second toner 208 to reduce relief differentials in a composite toner image 27 while composite toner image 27 is moved from printing module 48 by receiver movable surface toward fuser 60.

As is shown in FIG. 6A, toner layer balancing system 200 is located between print engine 22 and fuser 60 and has a second development station 202 and a second toning shell 204 that provides a second developer having a second toner 208 near a receiver 26 having an unfused composite toner image 27 such as the composite toner image 27 illustrated in FIG. 5. Second toner 208 is charged and has a potential of the same polarity the imagewise applied first toner 158. Second development station 202 has a second toner supply system 206 that provides charged second toner 208 of the first polarity to second toning shell 204 and a second power supply 210. Second toner supply system 206 can be of any design that maintains or that provides appropriate levels of charged second toner 208 at a second toning shell 204 during development.

As is also illustrated in FIGS. 6A-6C, opposite second toning shell 204 is a bias member 214. Second toning shell 204 and bias member 214 are separated by a second development area 216. A second power supply 210 provides a second toner development difference of potential VD2 of the first polarity between, in this embodiment, second toning shell 204 and bias member 214. The second toner development difference of potential VD2 has the same polarity as the first toner 158, the first development difference of potential VD1 and the initial difference of potential Vi. Bias member 214 can take any form that is consistent with the purpose of creating a bias as is described herein. In this embodiment, bias member 214 is illustrated as having a planar configuration and can comprise, for example, and without limitation, a plate, slide surface, support or grid. In other embodiments bias member 214 can comprise a pressure roller, belt or movable surface.

Second power supply 210 is operated to provide a bias between second toning shell 204 and bias member 214 to create the second development difference of potential VD2. In the embodiment of FIGS. 6A-6C, second power supply 210 is shown optionally being controlled by printer controller 82.

In the embodiment illustrated in FIGS. 6A-6C, receiver 26 has first toner 158 applied thereto in an imagewise fashion by at least one of printing modules 40, 42, 44, 46 and 48 of print engine 22 to form a composite toner image 27 that is moved from print engine 22 by a movable surface 30 of receiver transport system 28 which were shown and described with reference to FIG. 3. Movable surface 30 moves receiver 26 and composite toner image 27 through second development area 216 as receiver 26 is moved from print engine 22 to fuser 60.

As receiver 26 is moved through second development area 216, the second development difference of potential VD2 creates a second net development difference of potential Vnet2 between second toning shell 204, any first toner 158 at individual locations on receiver 26 and bias member 214. The second net development difference of potential Vnet2 for an individual location on receiver 26 is the second development difference of potential VD2 less any first toner difference of potential Vft provided by any first toner 158 an individual location on receiver 26.

Second toner 208 provided at second toning shell 204 is electrostatically urged to deposit at an individual location on receiver 26 in an amount that correlates to a magnitude of the second net development difference of potential Vnet2 at the individual locations. Here, the second development difference of potential VD2 is not more than the first development difference of potential VD1 such that for each location on the receiver 26 a total amount of first toner 158 and second toner 208 is maintained within a determined range. It will be appreciated that second toner 208 on second toning shell 204 deposits on individual locations on receiver 26 in an amount according to the second net development difference of potential. The amount increases as a function of the net second development difference of potential Vnet2 and such increase can occur monotonically. Where the second development difference of potential VD2 is approximately equal to the first development difference of potential VD1 second toner 208 is only applied to the extent that the difference of potential relative to ground of the first toner Vft is greater than VD2. Where VD2 is sufficiently less than that the first development difference of potential VD1, at least a determined amount of second toner 208 is applied on all locations on receiver 26.

The electrostatic forces that cause second toner 208 to deposit onto receiver 26 can include Coulombic forces between charged toner particles and the charged electrostatic latent image, and Lorentz forces on the charged toner particles due to the electric field produced by the bias voltages.

In one example embodiment, second development station 202 employs a two-component developer that includes toner particles and magnetic carrier particles. In this embodiment, second development station 202 includes a magnetic core 212 to cause the magnetic carrier particles near second toning shell 204 to form a "magnetic brush," as known in the electrophotographic art. Magnetic core 212 can be stationary or rotating, and can rotate with a speed and direction the same as or different than the speed and direction of second toning shell 204. Magnetic core 212 can be cylindrical or non-cylindrical, and can include a single magnet or a plurality of magnets or magnetic poles disposed around the circumference of magnetic core 212. Alternatively, magnetic core 212 can include an array of solenoids driven to provide a magnetic field of alternating direction. Magnetic core 212 preferably provides a magnetic field of varying magnitude and direction around the outer circumference of second toning shell 204. Further details of magnetic core 212 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. In other embodiments, first development station 140 can also employ a mono-component developer comprising toner, either magnetic or non-magnetic, without separate magnetic carrier particles. In further embodiments, first development station 140 can take other known forms that can perform development in any manner that is consistent with what is described and claimed herein.

As is noted above, first development station 140 is subject to development efficiency limitations. Accordingly, the first toner difference of potential Vft provided by first toner 158 at an engine pixel location can be less than the first net development difference of potential Vnet1 created at this engine pixel location during development of first toner 158. When this occurs, the first toner potential Vft provided by first toner 158 at a location on receiver 26 is less than the first development difference of potential VD1. However, when such a location on receiver 26 is exposed to the second development difference of potential VD2, a second net development difference of potential Vnet2 is created that is modulated as a function of the first toner difference of potential Vft at that location. This modulation as a function of first toner 158 occurs because the second net difference of potential increases as compared to what the second net difference of potential would be if a development efficiency of unity had been achieved during development of first toner 158. In such a case, the first development station 140 would have provided sufficient amounts of charged first toner 158 at each image modulated engine pixel location to form a first toner difference of potential Vft that would have been equal to first net development difference of potential Vnet1.

It will further be appreciated, that to the extent that first toner 158 comprises multiple imagewise applications of one or more first toners 158, such as a plurality of color separation first toners 158, variations in toner stack heights can be created as required to achieve color densities and also as a function of development efficiency issues. With each imagewise applied first toner 158 the total amount of first toner 158 that is potentially at a location on a receiver increases as does the extent of the variation from the total caused by development efficiency problems. Here too, toner layer balancing system 200 can provide a second toner as a function of the actual amount of first toner at a location because the second development is performed as a function of the second net development difference of potential Vnet2 that provides the electrostatic forces that cause the second toner 208 to develop at individual locations on the receiver is reduced or modulated by the difference of potential provided by all of the first toner 158 that is actually located at the individual locations.

Second toner 208 is different than first toner 158. This can take many forms, in one embodiment, first toner 158 can have first color characteristics while second toner 208 has different second color characteristics. In one example of this type, first toner 158 can be a toner of a first color having a first hue and second toner 208 can be a toner having the first color and a second different hue.

First toner 158 and second toner 208 can have different material properties. For example, in one embodiment comprises a toner of a first viscosity and the second toner comprises a toner of a second viscosity that is different from the first viscosity. In another embodiment, the first toner 158 can have a different glass transition temperature than the second toner 208. In one example of this type, the second toner 208 can have a lower glass transition temperature than the first toner 158. In certain embodiments, second toner 208 can take the form of a toner that will be clear, transparent or semi-transparent when fused. In other embodiments, second toner 208 can have finite transmission densities when fused.

First toner 158 and second toner 208 can be differently sized. For example, the first toner 158 can comprise toner particles of a size between 4 microns and 9 microns while the second toner 208 can have toner particles of a size between 10 microns and 20 microns or more. First toner 158 and second toner 208 can be made to have different shapes, can be formed using different processes, or can be provided with additional additives, coatings or other materials known in the art that influence the development, transfer or fusing of toner.

In general therefore, and without limitation, toner layer balancing system 200 and the methods that are described herein allow a second toner 208 to be applied to individual locations on a receiver 26 in amounts that are modulated based upon an amount of first toner 158 at such locations without requiring the use of a printing module to apply such second toner 208. Further, this can be done in a manner that enables improved gloss performance by reducing the extent of relief differentials caused by the color toner stacks.

FIG. 7 shows a first embodiment of a method for operating a printer. In a first step of this method, at least one first toner image is formed using a first toner charged to a first polarity (step 228). In this embodiment, this step is performed by the further steps of charging of a first polarity (step 230), establishing a first development difference of potential of the first polarity (step 232) and positioning a first toner for development (step 234).

In the charging step, step 230, selected engine pixel locations on a primary imaging member 112 are charged to have an image modulated difference of potential of a first polarity, with the image modulated difference of potential being between a lower potential V1 and a higher potential Vh relative to ground at engine pixel locations where toner is to be developed and to have an image modulated difference of potential at an initial difference of potential that is above the here potential at engine pixel locations where no first toner is to be developed. This can be done, for example, as described above in the printing module 48 of FIGS. 4A-4C, and 5A-5C using charging subsystem 120 and writing subsystem 130 to expose a photoreceptor 114 to selectively release charge on photoreceptor 114. In other embodiments, this step can also be performed using any other charging-writing system that is compatible with a discharge area development process.

A first development difference of potential VD1 is established at first toning shell 142 using, in this example, first power supply 150. The first development difference of potential VD1 is provided in a range between the higher difference of potential Vh and the lower difference of potential V1. This creates a first net development difference of potential Vnet1 defined by the difference between the first development difference of potential at first toning shell 142 and the individual image modulated difference of potential Vep1 at the engine pixel locations on primary imaging member 112. The first net development difference of potential Vnet1 for an engine pixel location is the first development difference of potential VD1 less any image modulated difference of potential Vep1 at the engine pixel location (step 232).

Particles of first toner 158 having a charge of the first polarity are positioned on first toning shell 142 proximate to the engine pixel locations on the primary imaging member 112 so that the first net development difference potential Vnet1 electrostatically urges first toner 158 to deposit at individual engine pixel locations according to the first net development difference of potential Vnet1 for the individual picture element locations (step 234). This forms a first toner image 25 on the PIM as shown in FIG. 4A.

The first toner image is then transferred to a receiver 26. This can be done for example, using transfer subsystem 50 as is shown and described with reference to FIGS. 4A-4C or using any other transfer system or method known in the electrophotographic or electrostatographic arts (step 236).

A second net development difference of potential Vnet2 is then created between second development station 202, bias member 214 and any first toner 158 on a location at a receiver (step 238). In this embodiment, this is done by moving receiver 26 and composite toner image 27 between second development station 202 and bias member 214 which, as discussed above, have a second development difference of potential VD2 of the first polarity relative to each other.

Accordingly, when the second toner 208 is positioned proximate to receiver 26, second development difference of potential VD2 causes second toner 208 to deposit on individual receiver locations in an amount that increases monotonically, or in some amount, whenever there is an increase in the second net difference of potential Vnet2 between second development difference of potential VD2, the difference of potential Vft of any first toner 158 at an individual engine pixel location (step 240).

In locations of receiver 26 on which no first toner 158 is transferred second toner 208 deposits at a full density. Thus, using the method of FIG. 7, it is possible to provide relatively uniform toner stack heights across regions of a receiver 26 having first toner 158 in a composite image 27 and across regions of a receiver 26 that have no first toner 158.

FIGS. 8A-8C provide illustrations depicting the operation of the method of FIG. 7 at different engine pixel and corresponding receiver pixel locations that each have a single first toner applied thereto according to different image modulated differences of potential Vep1.

FIG. 8A shows an engine pixel location 250 on primary imaging member 112 that is charged to an initial charge Vi. When engine pixel location 250 is moved through writing subsystem 130 no exposure is made. This can occur for example where the image data for an image to be printed does not require any toner to be recorded at engine pixel location 250. Accordingly, the image modulated difference of potential Vep1 at engine pixel location 250 remains at the initial difference of potential Vi. Because, in this example, first development difference of potential VD1 is not greater than Vi, there is no first net development difference of potential between first development station 140 and engine pixel location 250 as engine pixel location 250 is passes proximate to first development station 140. Accordingly, there is no development of first toner 158 to engine pixel location 250 and no first toner 158 is transferred from engine pixel location 250 to a corresponding location 31A on receiver 26.

When a corresponding location 31A on receiver 26 is exposed to the second development difference of potential VD2, the second development difference potential VD2 is not diminished by any first toner difference of potential Vft thus the second net development difference of potential Vnet2 is equal to the second development difference of potential VD2 and an correspondingly large amount of second toner 208 is applied to engine pixel location 250.

FIG. 8B illustrates the operation of the method of FIG. 7 on first toner 158 deposited at another engine pixel location 252 that is highly modulated during writing. In this example, first development difference of potential VD1 is not greater than initial voltage Vi. However, the first development difference of potential VD1 is greater than the image modulated difference of potential Vep1 of engine pixel location 252, which is at the lower difference of potential V1. Accordingly, when primary imaging member 112 is moved past first development station 140, first toner 158 deposits at engine pixel location 252 until an amount of the charged first toner 158 deposited at engine pixel location 252 reaches a first toner potential Vft that is determined by the first net difference of potential Vnet1 between first development difference of potential VD1 and the image modulated difference of potential Vep1 at engine pixel location 252 less a development shortfall 262 that arises when, as illustrated here, there is a development efficiency that is less than unity. Thus there is an image modulated amount of charged first toner 158 at engine pixel location 252 that transfers from engine pixel location 252 to a corresponding location 31B on receiver 26.

When a portion of receiver 26 having location 31B is passed between second development station 202 and bias member 214, a second net development difference of potential Vnet2 arises between second development station 202, bias member 214 and the difference of potential of the first toner Vft at location 31B. This second net development difference Vnet2 of potential causes second toner 208 to be developed at location 31B on receiver 26 until an amount of second toner 208 developed at location 31B reaches a difference of potential of second toner Vst that is at a second net development difference of potential Vnet2. Here too, the amount of second toner 208 developed at location 31B can also be subject to a second development shortfall 265 where the development efficiency of the second development station 202 is less than unity.

Accordingly, the amount of second toner 208 that deposits on location 31B during second development is modulated by the first toner difference of potential Vft of first toner 158 at location 31B such that sufficient amounts of charged second toner 208 are applied at location 31B to cause a total difference of potential at location 31B created by the total amount of the first toner and the second toner Vtot to be at the second development difference of potential VD2 less any second development shortfall 275 that arises during second development. This automatically occurs in registration at location 31B and at all locations on receiver 26 on which second toner 208 is applied according to the second development difference of potential VD2.

Importantly, this result is achieved without requiring that the second toner 208 be applied using a printing module and without the attendant need to generate an image to be printed by the separate printing module when applying second toner 208 to achieve this result FIG. 8C illustrates the operation of the method of FIG. 7 on first toner 158 that is developed at another engine pixel location 254 that is partially exposed during writing. In this example, first development difference of potential VD1 is not greater than initial difference of potential Vi, second development difference of potential VD2 is greater than first development difference of potential VD1, and first development difference of potential VD1 and second development difference of potential VD2 are greater than the image modulated difference of potential Vep1 of engine pixel location 254 which is set at a potential between the higher potential Vh and the lower potential V1.

When primary imaging member 112 is moved past first development station 140, first toner 158 develops at engine pixel location 254 until first toner 158 at engine pixel location 254 reaches a first toner difference of potential Vft that is generally the same as the first net development difference of potential Vnet1 of first development difference of potential VD1 less the image modulated difference of potential Vep1 of primary imaging member 112 at engine pixel location 254 less any development shortfall 272 that can arise when development efficiency of the first toner 158 is less than unity. Thus there is an image modulated amount of charged first toner 158 at engine pixel location 254 that transfers to a corresponding location 31C on receiver 26.

As is further shown in FIG. 8C, when location 31C on receiver 26 reaches second development station 202, second development difference of potential VD2 is established and second toner 208 is developed at engine pixel location 254 in an amount to provide a second net development difference of potential Vnet2 of the second development difference of potential VD2 less the first development difference of potential VD1 and less the image modulated difference of potential Vep1 at engine pixel location 254. The actual amount of second toner 208 developed at engine pixel location 254 can also be subject to a second development shortfall 275 that can be caused when the development efficiency of the of the second development station is less than unity.

It will be appreciated from FIGS. 8A-8C and the above description, that because second development difference of potential VD2 is set at a level that is greater than the first toner difference of potential Vft every location of receiver 26 has a second toner 208 applied thereto and that the amount of second toner 208 that deposits on individual engine pixel locations 252 and 254 during second development modulated by the first toner difference of potential Vft of first toner 158 developed at engine pixel locations 252 and 254. This result is achieved without requiring the use of a separate printing module and the attendant need to generate an image to be printed by the separate printing module to apply second toner 208 in an imagewise fashion.

It will also be noted from FIGS. 8A-8C that after a receiver 26 having a composite toner image 27 has been passed through the second development area 216, amounts of first toner 158 and second toner 208 at locations 31A, 31B and 31C each provide a total toner difference of potential Vtot that is generally equal to VD2 less any losses due to development efficiency during the development of second toner 208.

FIG. 9A conceptually illustrates amounts of first toner 158 at engine pixel locations 250, 252 and 254 after transfer to receiver locations 31A, 31B and 31C while FIG. 9B conceptually illustrates amounts of first toner 158 as shown in FIG. 9A with amounts of second toner 208 that area applied to receiver locations 31A, 31B and 31C during second development, presuming for the purposes of this discussion that the first toner 158 and the second toner 208 are developed in amounts that are proportional to the first net development difference of potential Vnet1, the net second difference of potential Vnet2 as is discussed with reference to FIGS. 8A, 8B and 8C. Such presumptions are not critical but are used here to simplify this discussion. It will be appreciated that in other embodiments where first toner 158 or second toner 208 can develop as a function of first net development difference of potential Vnet1 and second net development difference of potential Vnet2 in amounts that are not relatively proportional. Compensation for such different contributions to the amount of first toner 158 and second toner 208 provided in response to the same net development difference of potential can be achieved through adjustments of the first development difference of potential VD1, second development difference of potential VD2, the potential at each engine pixel location Vep1, or the magnitude of the charge on the first toner particles 158 or the second toner particles 208.

Similarly, for the purposes of FIGS. 9A and 9B it is assumed, without limitation, that first toner 158 and second toner 208 contribute to the toner stack height at a location on receiver 26 in a manner that is roughly equivalent for an equivalent amount of first toner 158 and second toner 208 thereon. However, here too this assumption is not critical and first toner 158 and second toner 208 can contribute to toner stack height at a location on receiver 26 in a different manner for an equivalent amount of first toner 158 and second toner 208 thereon. Here again compensation for such different manner of development can be made by adjustment of the first development difference of potential VD1, second development difference of potential VD2, the potential at each engine pixel location Vep1, or the magnitude of the charge on the first toner particles or the second toner particles.

As is shown in FIG. 9A, after development and transfer to receiver location 31A has no units of first toner 158 developed thereon. This yields a first toner stack height that is zero at engine pixel location 250 on primary imaging member 212. As is also shown in FIG. 9A, receiver location 31B has an amount of first toner 158 that creates seven units of stack height of first toner 158 and receiver location 31C has an amount of first toner 158 thereon to form a toner stack height of 4 units. Accordingly, in this case, a toner image that includes first toner 158 at receiver locations 31A, 31B and 31C provides a range of toner stack heights of at least 7 units of stack height in a first toner image 25 in this manner.

However, when the first toner 158 forming first toner image 25 is transferred from engine pixel locations 250, 252 and 254 to corresponding locations 31A, 31B and 31C on receiver 26 and second toner 208 is applied in the manner described above with reference to FIGS. 8B and 8C, second toner 208 is developed using a second development potential VD2 that is greater than a first development difference of potential VD1 such that each of locations 31A, 31B and 31C are developed with whatever amounts of second toner 208 are required to create a total potential Vtot at each of locations 31A, 31B and 31C that is generally equivalent to the second development difference of potential VD2 less any shortfall that arises where a development efficiency at the toner layer balancing system 200 is less than unity. In FIGS. 9A and 9B, second development difference of potential VD2 is sufficient to cause the sum of the amount of first toner 158 and the amount of second toner 208 applied at each of locations 31A, 31B and 31C to be 13 units.

Where this is done, the range of any variations in toner stack heights at locations 31A, 31B and 31C will be limited to any variations caused by development efficiency differences of second toner 208 at that arise between the development of second toner for locations 31A, 31B and 31C. This can substantially reduce the extent of any toner stack height variations from the total range of seven units found in the first toner image to, in the example illustrated in FIG. 8B, a range that can be, for example and without limitation, about 1 unit.

Thus, using toner layer balancing system 200, with a second development difference of potential VD2 that is greater than a first development voltage VD1, it is possible to provide both a clear toner layer on a composite toner image 27 having, in this example, one toner image 25 a receiver 26 and to do so in a manner that is modulated by a difference of potential relative to ground of the first toner 158 at locations on receiver 26 such that the sum of the amount of first toner 158 and the amount second toner 208 provided at each location are generally equivalent or at least within a range of variations that is less than a range of variation that is provided by the amounts of first toner 158 in the toner image. This improves overall gloss performance of such toner image after fusing by eliminating or substantially reducing the extent relief differentials in a toner image.

It will be appreciated from this that in a DAD writing system that has the first development station 140 and toner layer balancing system 200 as disclosed herein and that provides an initial charge of Vi no first toner 158 or second toner 208 is applied in areas of primary imaging member 112 that are not otherwise image modulated.

As is also shown in FIGS. 8A-8C, toner stack height variations caused by development efficiency limitations during first development are compensated for by the additional toner stack height added by second toner 208. Importantly this too is done while without using of the printing modules 40-48 in a print engine 22 to deliver image forming toner and without requiring that a printer controller 82 perform color separation processing and then calculate toner stack heights and then assemble a toner image.

It will be appreciated that in the above described embodiments, the second development difference of potential VD2 has been described as being greater than the first development difference of potential VD1. It will be appreciated that, in other embodiments, the second development difference of potential VD2 can be lower than first development difference of potential VD1 such that the second development difference potential VD2 can reduce the extent of relief differentials in the first toner image without necessarily providing sufficient amounts of second toner 208 to overcoat all of the toner stacks in the composite toner image 27. This can reduce the amount of second toner 208 that must be applied to reduce relief differentials composite toner image 27 while still providing an improvement in gloss.

For example, FIGS. 10A-10C illustrate the application of the method of FIG. 7 where a second development difference of potential VD2 is lower than a first development difference of potential VD1 applied at locations 31A, 31B and 31C to develop second toner 208.

As is shown in FIG. 10A, a primary imaging member 112 has an engine pixel location 250 with an initial charge Vi that is greater than the first development difference of potential VD1 and this charge is not reduced during writing. Accordingly, there is no development of first toner 158 at engine pixel location 250 and no first toner 158 is transferred to a corresponding location 31A on receiver 26. During second development, second toner 208 is developed at location 31A according to a second net development difference of potential Vnet2 that is roughly equal to second development difference of potential VD2.

As is shown in FIG. 10B, when a primary imaging member 112 has an engine pixel location 252 with an initial charge Vi but that has been discharged during writing to a lower difference of potential Vi, first toner 158 develops at engine pixel location 252 in an amount that is determined according to a first net development difference of potential Vnet1 that is roughly equal to the first development difference of potential VD1 less any development shortfall 272 due to development efficiency limitations at the first development station 142. When the first toner 158 that develops at engine pixel location 252 is transferred to a corresponding location 31B on receiver 26 and moved through inverse masking system 200, no second toner is transferred as the difference of potential of the first toner at location 31B is greater than the second development potential.

As is shown in FIG. 10C, when a primary imaging member 112 has an engine pixel location 254 with an initial charge Vi that is discharged to an engine pixel location difference of potential Vep1 that is greater than the lower voltage V1 but less than first development difference of potential VD1, first toner 158 develops at engine pixel location 254 according to the first net development difference of potential Vnet1 less any shortfall due to development efficiency 272. This amount of first toner is then transferred to receiver location 31C and receiver 26 is moved to bring receiver location 31C into second development area 216 where receiver location 31C is exposed to the second development difference of potential VD2 and to create a second net development difference of potential Vnet2 between second development difference of potential VD2 and the difference of potential of first toner Vft at receiver location 31C. Here, the difference of potential of the first toner Vft is lower than the second development difference of potential VD2 and some second toner 208 is developed at receiver location 31C according to the second net development difference of potential Vnet2.

FIGS. 11A and 11B illustrate toner leveling effects that arise when a first toner 158 is transferred corresponding locations 31A, 31B and 31C on receiver 26 and second toner 208 is applied in the manner described above with reference to FIGS. 10A, 10B and 10C. Here, second toner 208 is developed using a second development difference of potential VD2 that will cause, in the absences of any first toner difference of potential Vft sufficient second toner 208 to build a toner stack of 6 units. Second development difference of potential VD2 therefore is less than a first development difference of potential VD1 and in this example less than the difference of potential of first toner Vft at location 31B. Accordingly in this example, locations 31A and 31C are developed with whatever amounts of second toner 208 are required to create at least a total potential Vtot at each of locations 31A and 31C that is generally equivalent to the second development difference of potential VD2 less any shortfall that arises where a development efficiency at the toner layer balancing system 200 is less than unity. Thus, at location 31A six units of second toner 208 are developed, while at location 31C two units of second toner 208 are developed. However, at location 31B on receiver 26 the amount of first toner 158 has a first toner difference of potential Vft that is greater than the second development difference of potential VD2. Accordingly no second toner 208 is developed at location 31B. This creates a range of toner stack heights at locations 31A, 31B and 31C that is about one unit which is a reduction from the seven unit range of toner stack heights in between locations 31A, 31B and 31C and does so with reduced use of second toner 208 in untoned portions.

It will be appreciated, that the method of FIG. 7, can be used to cause toner layer balancing system 200 to help develop second toner 208 to reduce relief differentials in a composite toner image having more than one toner image such as a color separation toner image in which a composite toner image 27 is provided that typically has four colors of toner images applied in registration. This can occur because toner layer balancing system 200 is positioned after all of the color first toner have been applied by the respective printing modules of the print engine used in the printer and can be achieved where second development difference potential VD2 is provided at a level that causes a total amount of the first toner and any second toner deposition at each location on receiver 26 to be maintained within a range that is less than a range of first toner amounts on receiver 26.

There are a variety of ways in which the second development difference of potential VD2 can be established to achieve this result. In a first example, this result can be achieved by determining the second development difference of potential VD2 based upon a calculation of a high toner amount in the first toner on the receiver. In one example, this printer controller 82 can make such a calculation based upon the sum of the first development difference of potentials used during the development of each of the first toner images. In another embodiment, printer controller 82 can determine which location on receiver 26 will have the highest toner stack height and can make a calculation of a second development difference of potential VD2 on the basis of the toner stack height at that location.

Similarly, printer controller 82 can determine the second development difference of potential VD2 based upon information regarding the strategies, programming or algorithms that are used to, for example, by color separation processor 104 or half-tone processor 106 to convert image information into instructions that are sent to the printing modules. For example, where techniques such as under color removal or other strategies are used that seek to provide desired image content while conserving toner such strategies may dictate that toner stack heights for a composite image only reach a certain height. Similarly, where the use of other strategies, programming or algorithms are indicative of limitations on, toner stack heights or amounts of first toner 158 that can be applied by a combination of toner images 25 to form a composite toner image 27, printer controller 82 can use information regarding such other strategies to determine the second net development difference of potential Vnet2.

In an alternative embodiment, a high difference of potential in the first toner 158 of composite toner image 27 can be sensed by, for example, an electromagnetic sensor 242 that senses the potential relative to ground of the first toner 158. Such sensing can be done by detecting a change in an electromagnetic field generated proximate to the receiver, by sensing a change in a static electromagnetic field created by the first toner 158 or using other techniques known in the art. This sensed information can be used to determine the magnitude of the second development difference of potential VD2 required to achieve development of second toner 208 in amounts that are sufficient to create a desired reduction in the range of the total amount of toner at locations on a receiver 26 as compared to the range of first toner 158 of composite toner image 27 at locations on receiver 26.

Alternatively, the image densities of the composite toner image 27 can be sensed optically and signals indicative of the sensed densities can be provided to printer controller 82 from which printer controller 82 can determine information from which a determination of a second development difference of potential VD2 to be used in creating an inverse mask toner image can be made.

Such determinations can provide baseline information from which the second development difference of potential can be determined. For example, as discussed generally above, where a uniform overcoat of second toner is sought, the second development difference of potential VD2 for a composite toner image 27 having multiple first toner images can be set by printer controller 82 at a level that is at greater than the highest difference of potential of the first toner in the composite toner image. Alternatively, the second development difference of potential VD2 can be set at a level that is greater than a high difference of potential in the composite toner imaged such as by determining second development difference of potential VD2 as the sum of all development potentials used in the development of the composite toner image 27. In another alternative, the second development difference of potential can be set at a level this is at least as high as an amount of first toner at location on receiver 26 having a high amount of first toner 158. Similarly, the second development difference of potential VD2 can be set at a level that is at or above a sensed condition such as the above described sensing of the potential of the first toner Vft or the above described optical sensing.

As is shown in FIG. 12A, when, for example, a composite toner image 27 of FIG. 5 is presented to inverse masking system 200, toner layer balancing system 200 provides sufficient second toner 208 to bring the difference of potential of all toner at each location on receiver 26 to a desired total level Vtot. Here composite toner image 27 provides first toner 158 in toner stacks 29A-29N at locations 31A-31N on receiver 26 formed from the development of four first toner images, toner images: yellow (Y), Magenta (Mag.), Cyan (Cyan) and Black (Black) toner images that are transferred in registration on to receiver 26. Second development difference of potential VD2 is set according to instructions calling for an overcoat outcome or a high gloss outcome which printer controller 82 uses to determine a comparatively high second development difference of potential VD2 that is set at a level that allows sufficient second net development difference of potential Vnet2 to allow second toner 208 to be applied to composite toner image 27 such that the sum of the amount of first toner 158 and the amount of second toner 208 reaches a level that is determined by the second net development difference of potential Vnet2 and that, for each location on receiver 26 is greater than the amount of first toner 158.

As has been discussed herein in some embodiments, the second development difference of potential exceeds the first development difference of potential VD1. In one embodiment second development difference of potential VD2 exceeds the first development difference of potential VD1 by at least about 25 percent. This advantageously creates a relatively thick layer of second toner 208, and further allows additional second net development difference of potential Vnet2 during the development of second toner 208 to enable higher efficiency development at least during a portion of the second development.

In still other alternative embodiments such sensed or calculated conditions can be used to establish a baseline from which a second development difference of potential VD2 can be established that is intended to provide a total potential Vtot from the amounts of first toner plus second toner 208 that reduces the total range of toner mounts at each location on the receiver 26 without developing any second toner 208 on every toner stack. For example, as is discussed above, in certain circumstances it may be advantageous to set the second development difference of potential VD2 at a level that is at or lower than a high stack height of a composite toner image. This too can be done relative to a calculated or sensed condition or other determination from which the second development difference of potential can be determined.

One example of this is shown in FIG. 12B where the composite toner image 27 of FIG. 5 is passed through a second development area 216 with second development station and bias member 214 providing a second development difference of potential VD2 that set to such a level. As can be seen in FIG. 12B, second toner 208 is applied over toner stacks 29A, 29B, 29C, 29 . . . and 29N, however, the second development difference of potential VD2 is not high enough to develop any second toner 208 on toner stack 31D.

It will be appreciated that it can be valuable to selectively adjust the second development difference of potential during printing of an image on the receiver from a higher level potential is at least equal to the highest difference of potential of the first toner at any location on the receiver to a lower level such as where a portion of an image has image content that requires greater amounts of second toner than another portion having only text.

In the embodiments described above, second toner 208 has been described as being applied onto one or more first toner images 25 that have been referred to in various places as color separation toners, that provide differently colored toners or that form images according to color separation images. This has been done for convenience only and is not limiting. A first toner 158 can be applied according to any type of image or pattern and the color of the first toner 158 is not critical. Without limitation, a first toner 158 can be applied according to any first toner pattern such as a pattern that defines a structure that is to be formed on receiver 26 or an arrangement of toners that are of a type or that are applied in patterns that are intended to achieve functional outcomes such as forming structures, optical elements, electrical circuit components or circuits or desirable arrangements of biological material or components thereof. Similarly, a composite toner image 27 can have many different first toner images 25 applied in registration for functional reasons as well as printing or aesthetic reasons.

What is claimed is:

1. A printing method comprising the steps of:

forming at least one first toner image by charging a primary imaging member to have an image modulated difference of potential of a first polarity between a higher difference of potential and a lower difference of potential relative to a ground at individual engine pixel locations on the primary imaging member where toner is to be developed, and to have an image modulated difference of potential above the higher difference of potential at the individual engine pixel locations on the primary imaging member where no toner is to be developed;

establishing a first development difference of potential of the first polarity between the higher difference of potential and the lower difference of potential at a first development station to form a first net development difference of potential between the first development station and the individual engine pixel locations on the primary imaging member, with the first net development difference of potential being the first development difference of potential less any image modulated difference of potential at the individual engine pixel location; and positioning a first toner charged at the first polarity at the first development station such that the first toner is electrostatically urged to deposit in the individual engine pixel locations according to the first net development difference of potential for the individual engine pixel locations;

transferring the at least one first toner image and a second toner image in registration to form a composite toner image on a receiver;

creating a second net development difference of potential of the first polarity between a second development station, a bias member and the first toner at each location on the receiver used for printing, with the second net development difference of potential being a second development difference of potential between the second development station and the bias member less any difference of potential relative to ground of any first toner at the locations on the receiver; and providing a second toner of the first polarity at the second development station such that the second toner is electrostatically urged to deposit at individual locations on the receiver in amounts according to the second net development difference of potential at the individual locations;

wherein the second development difference of potential is set at a level such that second toner is deposited on the receiver to cause a total amount of first toner and any second toner deposited at each location on the receiver to be maintained within a range that is less than a range of first toner amounts on the receiver.

2. The method of claim 1, further comprising the steps of determining the second development difference of potential based upon a calculation of a high toner amount in the first toner on the receiver.

3. The method of claim 1, further comprising the steps of determining a location of high amount of first toner in a location on the receiver and establishing the second development difference of potential according to the difference of potential of the first toner at the location of a high first toner difference of potential.

4. The method of claim 3, further comprising the steps of sensing a high difference of potential provided by the first toner on the receiver and setting the second development difference of potential relative to the sensed high difference of potential on the receiver.

5. The method of claim 1, wherein only one first toner image is transferred and wherein the second development difference of potential is between the higher difference of potential and the lower difference of potential of the first development difference of potential.

6. The method of claim 1, further comprising the steps of sensing image densities of the composite toner image, determining a high amount of first toner difference of potential in the composite toner image using the sensed image densities of the composite toner image, and adjusting the second development difference of potential according to the sensed image densities.

7. The method of claim 1, wherein the second development difference of potential is at least equal to the highest difference of potential of the first toner at any location on the receiver.

8. The method of claim 1, wherein the second development difference of potential is adjusted during printing of an image on the receiver from a higher level potential at least equal to the highest difference of potential of the first toner at any location on the receiver to a lower level.

9. The method of claim 1, wherein the second toner is clear after fusing and the first toner is not clear after fusing.

10. The method of claim 1, wherein the second toner has toner particles that are a diameter that is different than toner particles of the first toner.

11. The method of claim 1, wherein the second toner has toner particles that are formed from a different material than toner particles in the first toner.

12. The method of claim 1, wherein the second toner has a different glass transition temperature than the first toner.

13. The method of claim 1, wherein the second toner has a lower glass transition temperature than the first toner.

14. The method of claim 1 further comprising the step of transferring the first toner and the second toner onto an intermediate transfer member and then transferring the first toner and the second toner from the intermediate transfer member onto a receiver.

15. The method of claim 1, wherein the first toner, the second toner and the primary imaging member have a negative polarity.

16. The method of claim 1, wherein a difference of potential between the second development difference of potential and the first development difference of potential is at least 25 percent of the first development difference of potential.

17. The method of claim 1, wherein the selected locations on the primary imaging member are charged by creating an initial difference of potential relative to ground at the engine pixel locations on a photoreceptor of the primary imaging member, and exposing the engine pixel locations to light to discharge engine pixel locations to an extent that is generally proportional to density information in an image being printed while leaving other engine pixel locations at the initial difference of potential.

18. The method of claim 17, wherein the second development difference of potential is greater than the initial difference of potential such that second toner is applied to engine pixel locations on which no first toner is recorded according to the difference of potential between the second development difference of potential and the initial difference of potential.

19. The method of claim 1, wherein the first toner comprises a toner of a first viscosity and the second toner comprises a toner of a second viscosity that is different from the first viscosity.

20. The method of claim 1, wherein the first toner has a first index of refraction and the second toner has a second index of refraction.

21. The method of claim 1, wherein the first toner is an electrical conductor and the second toner is a dielectric, a semi-conductor or an insulator.

* * * * *